US005429796A

United States Patent [19]

Larsen, Jr.

[11] Patent Number: 5,429,796

[45] Date of Patent: Jul. 4, 1995

[54] TIAL INTERMETALLIC ARTICLES

[75] Inventor: Donald E. Larsen, Jr., North Muskegon, Mich.

[73] Assignee: Howmet Corporation, Greenwich, Conn.

[21] Appl. No.: 143,553

[22] Filed: Oct. 26, 1993

Related U.S. Application Data

[62] Division of Ser. No. 696,184, Dec. 11, 1990, Pat. No. 5,284,620.

[51] Int. Cl.[6] ..... C22C 14/00

[52] U.S. Cl. ..... 420/590; 148/421; 420/418; 420/421

[58] Field of Search ..... 420/590, 418, 421; 148/421

[56] References Cited

U.S. PATENT DOCUMENTS

| | | | |
|---|---|---|---|
| 2,806,271 | 9/1957 | Operhall | 22/200 |
| 3,203,794 | 8/1965 | Jaffee et al. | 75/175.5 |
| 3,239,897 | 3/1966 | Lirones | 22/196 |
| 3,903,950 | 9/1975 | Lirones | 106/38.35 |
| 3,933,190 | 1/1976 | Fassler et al. | 164/26 |
| 4,247,333 | 1/1981 | Ledder et al. | 106/65 |
| 4,294,615 | 10/1981 | Blackburn et al. | 75/175.5 |
| 4,661,316 | 4/1987 | Hashimoto et al. | 420/418 |
| 4,710,348 | 12/1987 | Brupbacher et al. | 420/129 |
| 4,751,048 | 6/1988 | Christodoulou et al. | 420/129 |
| 4,772,452 | 9/1988 | Brupbacher et al. | 420/129 |
| 4,774,052 | 9/1988 | Nagle et al. | 420/129 |
| 4,800,065 | 1/1989 | Christodoulou et al. | 420/129 |
| 4,836,982 | 6/1989 | Brupbacher et al. | 420/129 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,849,168 | 7/1989 | Nishiyama et al. | 420/418 |
| 4,857,268 | 8/1989 | Huang et al. | 420/418 |
| 4,879,092 | 11/1989 | Huang | 420/418 |
| 4,897,127 | 1/1990 | Huang | 148/133 |
| 4,902,474 | 2/1990 | Huang et al. | 420/418 |
| 4,915,902 | 4/1990 | Brupbacher et al. | 420/129 |
| 4,915,903 | 4/1990 | Brupbacher et al. | 420/129 |
| 4,915,904 | 4/1990 | Christodoulou et al. | 420/418 |
| 4,915,905 | 4/1990 | Kampe et al. | 420/418 |
| 4,915,908 | 4/1990 | Nagel et al. | 420/590 |
| 4,916,028 | 4/1990 | Huang | 428/614 |
| 4,916,029 | 4/1990 | Nagle et al. | 428/614 |
| 4,916,030 | 4/1990 | Christodoulou et al. | 428/614 |
| 4,917,964 | 4/1990 | Moshier et al. | 428/614 |
| 5,080,860 | 1/1992 | Huang | 148/421 |
| 5,082,506 | 1/1992 | Huang | 420/418 |
| 5,082,624 | 1/1992 | Huang | 148/421 |
| 5,093,148 | 3/1992 | Christodoulou et al. | 427/37 |
| 5,098,653 | 3/1992 | Huang | 420/418 |
| 5,190,603 | 3/1993 | Nazmy et al. | 420/418 |
| 5,205,875 | 4/1993 | Huang | 420/421 |

FOREIGN PATENT DOCUMENTS 220571 7/1957 Australia .

OTHER PUBLICATIONS

T. Tsujimoto, Research, Development, and Prospects of TiAl Intermetallic Compound Alloys, Titanium and Zirconium, vol. 33, No. 3 pp. 7–17, 1985.

Whang et al., Effect of Rapid Solidification in $L1_0$ TiAl Compound Alloys, Materials Week, 1986.

A Preliminary Study of the Microstructure–Property Relationships in Cast Gamma Titanium Aluminide Alloys; Proceeding of TMS Fall Meeting, Oct. 7–11, 1990; London and Kelly.

Effect of XD TM $TiB_2$ Volume Fraction on the Microstructure of a Cast Near–Gamma Titanium Aluminide (List continued on next page.)

*Primary Examiner*—Upendra Roy

[57] ABSTRACT

A TiAl alloy base melt including at least one of Cr, C, Ga, Mo, Mn, Nb, Ni Si, Ta, V and W and at least about 0.5 volume % boride dispersoids is investment cast to form a crack-free, net or near-net shape article having a gamma TiAl intermetallic-containing matrix with a grain size of about 10 to about 250 microns as a result of the presence of the boride dispersoids in the melt. As hot isostatically pressed and heat treated to provide an equiaxed grain structure, the article exhibits improved strength.

6 Claims, 19 Drawing Sheets

OTHER PUBLICATIONS

Alloy; Mat. Res. Soc, Symp. Proceedings, vol. 194, 1990; Larsen, Kampe and Christodoulou.

Influence of Matrix Phase Morphology on Fracture Toughness in a Discontinuity Reiforced XD TM Titanium Aluminide Composite; Scripta Metallurgical et Materialia, vol. 24, pp. 851–856, 1990.

Investment-Cast Gamma and XD TM Gamma Titanium Aluminide Alloy Technology; NASA White Paper, Oct. 1989; London, Larsen Freeman.

Intermetallic Alloys Based on Gamma Titanium Aluminide; JOM 41 (7), 1989; Young-Won Kim.

XD TM Titanium Aluminide Composites; Mat. Res. Soc. Symp. Proc. vol. 120, 1988 Materials Research Society; Christodoulou, Parrish and Crowe.

Induction Skull Melting of Titanium Aluminides and Other Reactive Metals; Industrial Heating, Jan., 1990, pp. 20–33; D. Scott Reed.

High Temperature Aluminides & Intermetallics; proceedings of TMS Fall Meeting, Oct. 1–5, 1989; Wang, Liu, Pope and Stiegler; pp. 557–584.

LACEY

LACEY + BLOCKY

LACEY + BLOCKY + NEEDLE

BLOCKY + NEEDLE

TIAL INTERMETALLIC ARTICLES

This is a division of Ser. No. 07/696,184, filed Dec. 11, 1990 now U.S. Pat. No. 5,284,620.

FIELD OF THE INVENTION

The present invention relates to a method of making articles based on TiAl intermetallic materials and, more particularly, to TiAl intermetallic base articles having a net or near-net shape for an intended service application and having improved strength.

BACKGROUND OF THE INVENTION

For the past several years, extensive research has been devoted to the development of intermetallic materials, such as titanium aluminides, for use in the manufacture of light weight structural components capable of withstanding high temperatures/stresses. Such components are represented, for example, by blades, vanes, disks, shafts, casings and other components of the turbine section of modern gas turbine engines where higher gas and resultant component temperatures are desired to increase engine thrust/efficiency and other applications requiring light weight, high temperature materials.

Intermetallic materials, such as gamma titanium aluminide, exhibit improved high temperature mechanical properties, including high strength-to-weight ratios, and oxidation resistance relative to conventional high temperature titanium alloys. However, general exploitation of these intermetallic materials has been limited by the lack of strength, room temperature ductility, and toughness, as well as the technical challenges associated with processing and fabricating the material into the complex end-use shapes that are exemplified, for example, by the aforementioned turbine components.

The Kampe et al U.S. Pat. No. 4,915,905 issued Apr. 10, 1990 describes in detail the development of various metallurgical processing techniques for improving the low (room) temperature ductility and toughness of intermetallic materials and increasing their high temperature strength. The Kampe et al '905 patent relates to the rapid solidification of metallic matrix composites. In particular, in this patent, an intermetallic-second phase composite is formed; for example, by reacting second phase-forming constituents in the presence of a solvent metal, to form in-situ precipitated second phase particles, such as boride dispersoids, within an intermetallic-containing matrix, such as titanium aluminide. The intermetallic-second phase composite is then subjected to rapid solidification to produce a rapidly solidified composite. Thus, for example, a composite comprising in-situ precipitated $TiB_2$ particles within a titanium aluminide matrix may be formed and then rapidly solidified to produce a rapidly solidified powder of the composite. The powder is then consolidated by such consolidation techniques as hot isostatic pressing, hot extrusion and superplastic forging to provide near-final (i.e., near-net) shapes.

U.S. Pat. No. 4,836,982 to Brupbacher et al also relates to the rapid solidification of metal matrix composites wherein second phase-forming constituents are reacted in the presence of a solvent metal to form in-situ precipitated second phase particles, such as $TiB_2$ or TiC, within the solvent metal, such as aluminum.

U.S. Pat. Nos. 4,774,052 and 4,916,029 to Nagle et al are specifically directed toward the production of metal matrix-second phase composites in which the metallic matrix comprises an intermetallic material, such as titanium aluminide. In one embodiment, a first composite is formed which comprises a dispersion of second phase particles, such as $TiB_2$, within a metal or alloy matrix, such as Al. This composite is then introduced into an additional metal which is reactive with the matrix to form an intermetallic matrix. For example, a first composite comprising a dispersion of $TiB_2$ particles within an Al matrix may be introduced into molten titanium to form a final composite comprising $TiB_2$ dispersed within a titanium aluminide matrix. U.S. Pat. No. 4,915,903 to Brupbacher et al describes a modification of the methods taught in the aforementioned Nagle et al patents.

An attempt to improve room temperature ductility by alloying intermetallic materials with one or more metals in combination with certain plastic forming techniques is disclosed in the Blackburn U.S. Pat. No. 4,294,615 wherein vanadium was added to a TiAl composition to yield a modified composition of Ti-31 to 36% Al-0 to 4% V. The modified composition was melted and isothermally forged to shape in a heated die at a slow deformation rate necessitated by the dependency of ductility of the intermetallic material on strain rate. The isothermal forging process is carried out at above 1000° C. such that special die materials (e.g., a Mo alloy known as TZM) must be used. Generally, it is extremely difficult to process TiAl intermetallic materials in this way as a result of their high strength, high temperature nature and the dependence of their ductility on strain rate.

A series of U.S. patents comprising U.S. Pat. Nos. 4,836,983; 4,842,817; 4,842,819; 4,842,820; 4,857,268; 4,879,092; 4,897,127; 4,902,474; and 4,916,028, have described attempts to make gamma TiAl intermetallic materials having both a modified stoichiometric ratio of Ti/Al and one or more alloyant additions to improve room temperature strength and ductility. In making cylindrical shapes from these modified compositions, the alloy was typically first made into an ingot by electro-arc melting. The ingot was melted and melt spun to form rapidly solidified ribbon. The ribbon was placed in a suitable container and hot isostatically pressed (HIP'ped) to form a consolidated cylindrical plug. The plug was placed axially into a central opening of a billet and sealed therein. The billet was heated to 975° C. for 3 hours and extruded through a die to provide a reduction of about 7 to 1. Samples from the extruded plug were removed from the billet and heat treated and aged.

U.S. Pat. No. 4,916,028 (included in the series of patents listed above) also refers to processing the TiAl base alloys as modified to include C, Cr and Nb additions by ingot metallurgy to achieve desirable combinations of ductility, strength and other properties at a lower processing cost than the aforementioned rapid solidification approach. In particular, the ingot metallurgy approach described in the '028 patent involves melting the modified alloy and solidifying it into a hockey puck-shaped ingot of simple geometry and small size (e.g., 2 inches in diameter and 0.5 inch thick), homogenizing the ingot at 1250° C. for 2 hours, enclosing the ingot in a steel annulus, and then hot forging the annulus/ring assembly to provide a 50% reduction in ingot thickness. Tensile specimens cut from the ingot were annealed at various temperatures above 1225° C. prior to tensile testing. Tensile specimens prepared by this ingot metallurgy approach exhibited lower yield strengths but greater ductility than specimens prepared by the rapid solidification approach.

Despite the improvements described hereabove in the ductility and strength of intermetallic materials, there is a continuing desire and need in the high performance material-using industries, especially in the gas turbine engine industry, for intermetallic materials with improved properties or combinations of properties and also for manufacturing technology that will allow the fabrication of such intermetallic materials into usable, complex engineered end-use shapes on a relatively high volume basis at much lower cost. It is an object of the present invention to satisfy these desires and needs.

SUMMARY OF THE INVENTION

The present invention involves a method of making titanium aluminide base intermetallic articles having a net or near-net shape for intended service application and having improved strength. The method of the present invention involves forming a titanium-aluminum melt comprising (in atomic %) Ti in an amount of about 40% to about 52%, Al in an amount of about 44% to about 52%, and one or more of Cr, C, Ga, Mo, Mn, Nb, Ni, Si, Ta, V, and W each in an amount of about 0.05% to about 8%. Boride dispersoids are provided in the melt in an amount of at least about 0.5 volume % of the melt. Preferably, a low volume % of boride dispersoids in the range of about 0.5 to about 2.0 volume % is provided in the melt.

The dispersoid-containing melt is cast and solidified in-a mold cavity of a ceramic investment mold wherein the mold cavity is configured in the net or near-net shape of the article to be cast. The melt is solidified in a manner to yield a crack-free, net or near-net shape cast article comprising a titanium aluminide-containing matrix (e.g., gamma TiAl) having a grain size of about 50 to about 250 microns as a result of grain refinement from the boride dispersoids being distributed throughout the melt during solidification. The melt is solidified in the mold at a cooling rate sufficiently fast to avoid migration of the boride dispersoids to the grain boundaries during solidification and yet sufficiently slow to avoid cracking of the article. A cooling rate in the range of about $10^2$ to about $10^{-3}$° F./second is preferred to this end. Following solidification, the net or near-net shape, investment cast article may be subjected to a consolidation operation to close any porosity in the as-cast condition. The consolidated article may then be heat treated to provide at least a partially equiaxed grain morphology.

In one embodiment of the invention, the boride dispersoids are provided in the melt by introducing a preformed boride master material to the melt. In another embodiment of the invention, the boride dispersoids are provided in the melt by introducing an effective amount of elemental boron in the melt to form the desired volume % of borides in-situ therein. Regardless of how the boride dispersoids are provided in the melt, the melt is maintained at a selected superheat temperature for a given melt hold time prior to casting to avoid deleterious coarsening (growth) of the boride particles (dispersoids) present in the melt.

The present invention also involves a titanium aluminide base article having a net or near-net investment cast shape for intended service application and a titanium aluminide-containing matrix (e.g., gamma TiAl) consisting essentially of (in atomic %) about 40% to about 52% Ti, about 44% to about 52% Al and one or more of Cr, C, Ga, Mo, Mn, Nb, Si, Ta, V and W each included in an amount of about 0.05% to about 8%. The matrix includes at least about 0.5 volume % boride dispersoids distributed uniformly throughout and a fine, equiaxed, grain structure have a grain size of about 10 to about 250 microns. Preferably, the article, as consolidated and heat treated to provide the partially equiaxed grain structure, exhibits a yield strength at room temperature (70° F.) of at least about 55 ksi and a tensile ductility at room temperature of at least about 0.5% (measured by the ASTM ESM test procedure).

Thus, the present invention has as a particular purpose to provide net or near-net shape articles of a TiAl base intermetallic material modified by the addition of selected alloyant(s)/dispersoids and formed to shape by investment casting in a crack-free condition treatable by consolidation/heat treatment to exhibit improved strength and ductility at room temperature. The method of the invention provides an alternative to much more costly techniques heretofore used to fabricate TiAl base intermetallics.

The advantages of the present invention will become more readily understood by consideration of the following detailed description and examples.

DETAILED DESCRIPTION OF THE INVENTION

The present invention relates to net or near-net shape articles comprised of a titanium aluminide base intermetallic material modified by the addition of selected alloyant(s)/dispersoids and formed to shape by investment casting in a crack-free, fine grained condition treatable by consolidation/heat treatment to exhibit improved strength at room temperature. Titanium-aluminum base alloys employed in practicing the present invention consist essentially of, by atomic %, about 40% to about 52% Ti, about 44% to about 52% Al and one or more of the alloyants Cr, C, Ga, Mo, Mn, Nb, Ni, Si, Ta, V,and W each in an amount of about 0.05% to about 8%. The listed alloyants are provided in the base composition as a result of their beneficial effect on ductility when present in certain combinations and/or concentrations.

A preferred base alloy for use in practicing the present invention consists essentially of, by atomic %, about 44% to about 50% Ti, about 46% to about 49% Al and at least one of Cr, C, Ga, Mo, Mn, Nb, Ni, Si, Ta, V,and W wherein Cr, Ga, Mo, Mn, Nb, Ta, V and W, when present, are each included in an amount of about 1% to about 5% and wherein C, Ni and Si, when present, are each included in an amount of about 0.05% to about 1.0%. Two or more of the alloyants Cr, C, Ga, Mo, Mn, Nb, Si, Ta, V and W are present in an even more preferred embodiment within the concentration ranges given. Although the present invention is not limited to a particular base composition within the ranges set forth hereabove, certain specific preferred base compositions are described in the Examples set forth hereinbelow.

Figure 1:
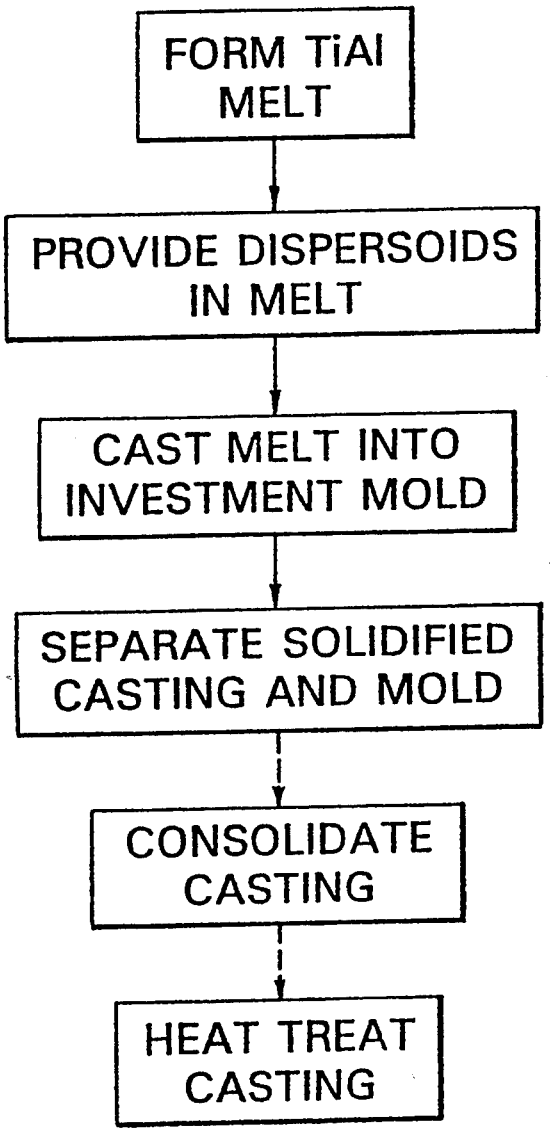
FIG. 1 is a flow sheet illustrating one embodiment of the method of the invention.

Referring to FIG. 1, the various steps involved in practicing one embodiment of the method of the invention are illustrated. In this embodiment, a melt of the TiAl base alloy is formed in a suitable container, such as a crucible, by a variety of melting techniques including, but not limited to, vacuum arc melting (VAR), vacuum induction melting (VIM), induction skull melting (ISR), electron beam melting (EB), and plasma arc melting (PAM). In the vacuum arc melting technique, an electrode is fabricated of the base alloy composition and is melted by direct electrical arc heating (i.e., an arc established between the electrode and the crucible) into an underlying non-reactive crucible. An actively cooled copper crucible is useful in this regard. Vacuum induction melting involves heating and melting a charge of the base alloy in a non-reactive, refractory crucible by induction heating the charge using a surrounding electrically energized induction coil. Induction skull melting involves inductively heating and melting a charge of the base alloy in a water-cooled, segmented, non-contaminating copper crucible surrounded by a suitable induction coil. Electron beam melting and plasma melting involve melting using a configuration of electron beam(s) or a plasma plume directed on a charge in an actively cooled copper crucible. These melting techniques are known generally in the art of melting of metals and alloys.

Although the present invention is not limited to any particular melting process, certain specific melting processes are described in the Examples set forth hereinbelow.

Referring again to FIG. 1, the melt of the TiAl base alloy in the container (crucible) is provided with boride dispersoids in an amount of at least about 0.5 volume % prior to casting of the melt in an investment mold to be described in detail herebelow. Typically, the boride dispersoids comprise simple titanium borides ($TiB_2$) and/or complex borides such as $(Ti,M)_xB_y$ where M is Nb, W, Ta or other alloyant. Although varying amounts of the boride dispersoids may be used depending upon the end-use properties desired for the cast article, relatively low boride dispersoids levels of about 0.5 to about 20.0 volume % are useful in practicing the invention to achieve the desired grain refinement effects in the casting as well as strength and ductility improvements upon further treatment of the casting. Boride dispersoid levels above the upper limit set forth tend to reduce ductility and thus are not preferred. In accordance with the invention, optimum strength and ductility are achieved when the boride dispersoid level is preferably about 0.5 to about 2.0 volume % of the melt or cast article.

The TiAl base alloy melt described hereabove can be provided with the desired level of boride dispersoids in a variety of ways including the addition of a boride master material to the melt in accordance with U.S. Pat. Nos. 4,751,048 and 4,916,030, the teachings of which are incorporated herein by reference. In particular, a porous sponge having a relatively high concentration of boride particles (e.g., $TiB_2$) is introduced and incorporated in the TiAl base melt to provide a lower concentration of boride particles therein. Of course, the concentration of boride particles in the sponge is chosen to yield a selected lower concentration of the particles in the melt; for example, at least about 0.5 volume % boride dispersoids in the melt. Boride master materials (i.e. sponges) useful in practicing the present invention are available from Martin Marietta Corporation, Bethesda, Md. and its licensees.

The TiAl base alloy melt also can be provided with the desired level of boride dispersoids by providing an effective amount of elemental boron in the melt to form and precipitate the aforementioned simple and/or complex titanium boride particles in-situ therein. When using the VAR melting process to form the TiAl base melt, elemental boron can be provided in the melt by dispersing elemental boron in the VAR electrode with the other alloyants as described in the Examples herebelow. When the electrode is melted into the underlying crucible, the TiAl base composition and the boron are brought together in,the melt so that the boron can react with metals in the melt to precipitate simple borides (e.g., $TiB_2$) and/or complex borides (e.g., $(Ti,Nb)_xB_y$ in the melt. When using the vacuum induction, induction skull, electron beam and plasma melting processes referred to hereabove, the elemental boron can be provided in the melt by blending with the initial alloyants of the charge to be melted or by addition to the already melted alloy charge.

Other methods of providing the desired level of boride dispersoids in the melt are described in U.S. Pat. Nos. 4,915,052 and 4,916,029, although the present invention is not limited to any particular technique in this regard.

Importantly, the dispersoid-containing TiAl base alloy melt is maintained at a selected superheat temperature (for a given melt hold time prior to casting)-to avoid growth of the boride particles present in the melt to a harmful size. Namely, the superheat of the melt is maintained sufficiently low so as to avoid formation of deleterious TiB needles (whiskers) having a length greater than about 50 microns. These TiB needles form from the existing $TiB_2$ particles in the melt by particle growth processes and are quite harmful to the properties, especially the ductility, of the casting. In general, the superheat temperature of the melt is maintained at the melting temperature of the TiAl base composition plus about 25° to 200° F. thereabove to this end. Temperature maintenance in this manner fosters the presence of blocky (e.g., equiaxed), lacey and/or small needles (less than about 50 microns length) of $TiB_2$ in the melt. Such boride particles are illustrated schematically in FIGS. 17A–17D.

Preferably, the dispersoid-containing TiAl base alloy melt is stirred in the crucible prior to casting. When the aforementioned VAR, VIM, ISR and other melting techniques are used, the melt is stirred in the crucible by the action of an induction heating coil on the melt. Melt stirring in this manner maintains a homogenous melt with the boride dispersoids distributed uniformly throughout.

Melting and casting of the TiAl base alloy containing the boride dispersoids is conducted under relative vacuum (e.g., 1 micron vacuum) or under inert atmosphere (e.g., .5 atmosphere Ar) to minimize contamination of the melt.

The dispersoid-containing TiAl base alloy melt is cast into a non-reactive, ceramic investment mold having one or more mold cavities configured in the net or near-net shape of the article to be cast. Net shape castings require no machining to achieve final print dimensions/tolerances. Near-net shape castings may require only a minor machining operation of the casting, or portion thereof, to provide final print dimensions/tolerances. Investment molds used in practicing the invention are made in accordance with conventional mold forming processes wherein a fugative pattern (e.g., a wax pattern) having the near-net shape to be cast is repeatedly dipped in a ceramic slurry, stuccoed with ceramic particulate and then dried to build up a suitable shell mold about the pattern. After the desired thickness of the shell mold is formed, the pattern is removed from the mold, leaving one or more mold cavities therein. When wax patterns are used, the patterns can be removed by known dewaxing techniques, such as steam autoclave dewaxing, flash dewaxing in a furnace and the like. After pattern removal, the shell mold is treated at elevated temperatures to remove absorbed water and gases therefrom. Although the invention is not limited to any particular mold formation process, certain specific mold formation processes are set forth in the Examples herebelow.

The investment mold is made from ceramic materials which will be substantially nonreactive with the TiAl base alloy melt so as not react with and contaminate the melt. In particular, the mold facecoat that contacts the melt typically comprises a ceramic material selected from zirconia, yttria and the like to this end. The mold coats subsequently applied to the facecoat (i.e., the backup coats) may be selected from a variety of ceramic materials depending upon the particular casting application involved. The investment mold may be made in various configurations as needed for a particular casting application.

Referring to FIG. 1, the dispersoid-containing TiAl base alloy melt at the appropriate superheat temperature is cast (e.g., poured) from the melting crucible into a preheated investment mold and solidified therein to form a net or near-net shape, cast article whose microstructure will be described in detail herebelow. The melt may be gravity or countergravity cast into an investment mold that is stationary or that is rotated as, for example, in centrifugal casting processes. Regardless of the casting method employed, the cooling (freezing) rate of the melt and cooling rate of the casting are controlled so as to be fast enough to prevent migration and segregation of the boride dispersoids to the grain boundaries and yet slow enough to avoid cracking of the solidified casting. The cooling rate employed will depend upon the melt superheat, the section size of the casting to be produced, the configuration of the casting to be produced, the particular TiAl base alloy composition, the loading level of dispersoids in the melt as well as other factors. In general, cooling rates of about $10^2$ to about $10^{-3}$° F. per second are employed to this end. Such cooling rates are typically achieved by placing the melt-filled investment mold in a bed of refractory material (e.g., $Al_2O_3$) and allowing the melt to solidify to ambient temperature. Once the casting has cooled to ambient temperature (or other demold temperature), the casting and the investment mold are separated in usual manner, such as by vibration.

Referring again to FIG. 1, following separation of the mold and the casting, the casting may be subjected to a consolidation operation to close any porosity in the casting. Preferably, the casting is hot isostatically pressed at, for example, 2100°–2400° F. and a pressure of 10–45 ksi for 1–10 hours depending on the size of the casting, to close any porosity present in casting. Thereafter, the HIP'ped casting is heat treated to provide at least a partially equiaxed grain structure in lieu of the lamellar grain structure present in the as-cast microstructure. Heat treat parameters of 1600°–2500° F. for 1–75 hours may be used. Of course, other consolidation processes/parameters and heat treatment processes/parameters can be employed in practicing the invention.

The titanium aluminide base casting produced in accordance with the present invention is characterized as having a net or near-net shape for the intended service application and a predominantly gamma TiAl intermetallic matrix corresponding in composition to that of the base composition. The matrix exhibits a fine, as-cast grain structure of lamellar morphology and a grain size within the range of about 10 to about 250 microns, preferably about 50 to about 150 microns. The matrix may include other titanium aluminide phases (e.g., $Ti_3Al$ or $TiAl_3$) in minor amounts such as up to about 15.0 volume %. The as-cast lamellar grain structure is changed to a partially equiaxed grain structure by the subsequent heat treatment operation.

As will become apparent from the Examples set forth herebelow, a certain minimum level of boride dispersoids, such as at least about 0.5 volume % dispersoids, must be uniformly distributed throughout the melt during solidification in order to achieve a grain refinement effect that yields as-cast and heat treated grain sizes in the aforementioned ranges for strength enhancement purposes. Dispersoid levels below the minimum level are ineffective to produce the fine as-cast grain sizes required for improved strength. The dispersoids are distributed generally uniformly throughout the as-cast matrix (as shown in FIGS. 5, 6, 13 and 14) and are not segregated at the grain boundaries.

As will also become apparent from the Examples set forth herebelow, the boride dispersoids are present in the matrix in various morphologies including a) ribbon shapes generally 0.1–2.0 microns thick, 0.2–5.0 microns wide and 5.0–1000 microns long, b) blocky (equiaxed) shapes generally of 0.1–50.0 microns average size (major particle dimension), c) needle shapes generally 0.1–5.0 microns wide and 5.0–50.0 microns long, and d) acicular shapes generally 1.0–10.0 microns wide and 5.0–30.0 microns long. These various dispersoids particle shapes are illustrated schematically in FIG. 17. As mentioned hereabove, large TiB needles having a length greater than about 50 microns are to be avoided in the matrix so as not to adversely affect the ductility of the casting.

Consolidated and heat treated TiAl intermetallic base investment castings in accordance with the invention typically exhibit a yield strength at room temperature (70° F.) of at least about 55 ksi and a ductility at room temperature of at least 0.5% as measured by the ASTM ESM test procedure. Consolidated and heat treated TiAl intermetallic base investment castings of the invention having the aforementioned even more preferred composition typically exhibit a yield strength at room temperature (70° F.) of at least about 60 ksi and a ductility at room temperature of at least about 1.0% as measured by the same ASTM test procedure. These room temperature properties represent a substantial improvement over the room temperature properties demonstrated heretofore by investment cast TiAl intermetallic materials which have not been modified by addition of borides or boron.

The following Examples are offered to illustrate the invention in further detail without limiting the scope thereof.

EXAMPLE 1

This example illustrates practice of one embodiment of the invention wherein elemental boron is provided in the TiAl base alloy melt in order to form boride dispersoids in-situ therein. Various amounts of elemental boron were provided in the TiAl base melt to determine the dependence of grain refinement on the amount of boride dispersoids present in the melt. The following melt compositions were prepared by the VAR melting process referred to hereabove:

Alloy A - - - Ti-47.1% Al-2.1% Nb-1.6% Mn-0.047% B (0.04 v/o borides)

Alloy B - - - Ti-47.8% Al-2.1% Nb-2.4% Mn-0.11% B (0.07 v/o borides)

Alloy C - - - Ti-46.9% Al-2.0% Nb-1.7% Mn-0.17% B (0.13 v/o borides)

Alloy D - - - Ti-47.2% Al-2.0% Nb-1.5% Mn-0.3% B (0.27 v/o borides or 0.30 atomic % B)

Alloy E - - - Ti-48.4% Al-2.0% Nb-1.5% Mn-1.0% B (0.70 v/o borides or 1.0 atomic % B)

Alloy F - - - Ti-45.3% Al-1.9% Nb-1.6% Mn-2.49% B (1.94 v/o borides or 2.5 atomic % B)

A cylindrical electrode of each of these TiAl base alloy compositions was prepared by cold pressing Ti sponge, Al pellets, Al/Nb master alloy chunks, Al/Mn master alloy chunks and elemental boron powder in the appropriate amounts in a Ti tube. The cold pressed body was subjected to a first melting operation to produce an ingot. The ingot was grit blasted and then remelted again to produce the electrode. Each electrode was then VAR melted into a copper crucible to form a TiAl base alloy melt in which elemental boron was present.

Each TiAl alloy melt was maintained at a superheat temperature of about 25° F. above the melting point by VAR melting prior to casting. Agitation during VAR melting also acted to stir the melt prior to casting. Each melt was poured from the crucible into a preheated (600° F.) ceramic investment mold comprising a $Zr_2O_3$ mold facecoat for contacting the melt and nine backup coats of $Al_2O_3$. Each mold included five mold cavities in the shape of cylinders having the following dimensions: 0.625 inch diameter x 8 inches long. Each melt was melted and cast into the mold under 7 microns vacuum. Each melt-filled molds was placed in a bed of $Al_2O_3$ (to a depth of about 8 inches) and allowed to cool to ambient temperature over a period of about 2 hours. Each mold and the cylindrical-shaped casting were then separated.

Figure 2A:
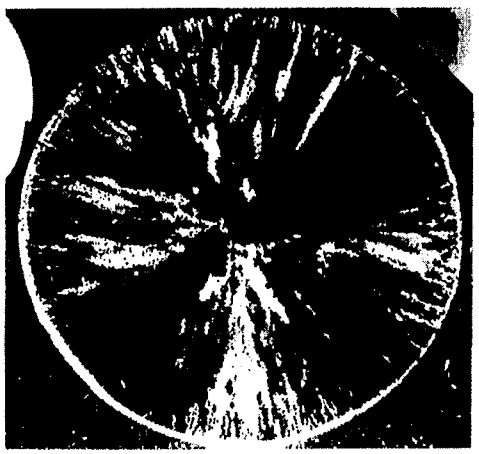
FIGS. 2A through 2F are photomicrographs of investment castings of Alloys A through E, respectively, illustrating the effect of increasing boron in the melt on grain refinement.
Figure 2B:
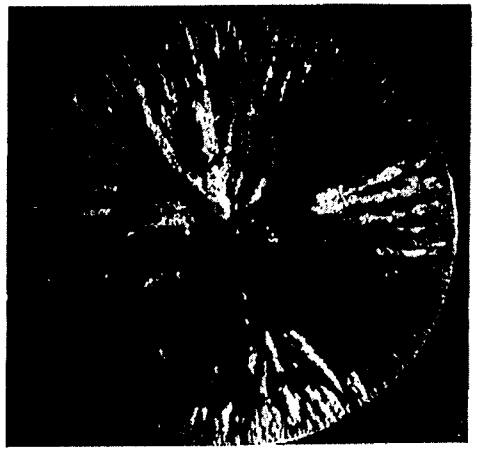
Figure 2C:
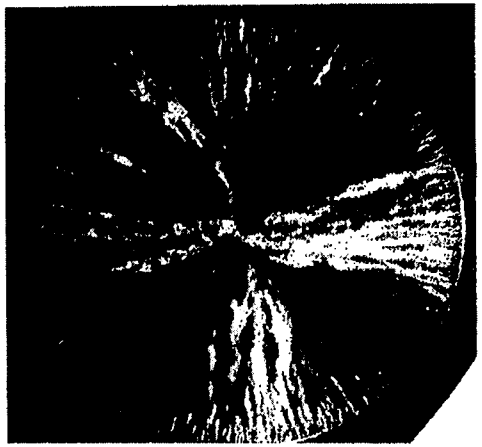
Figure 2D:
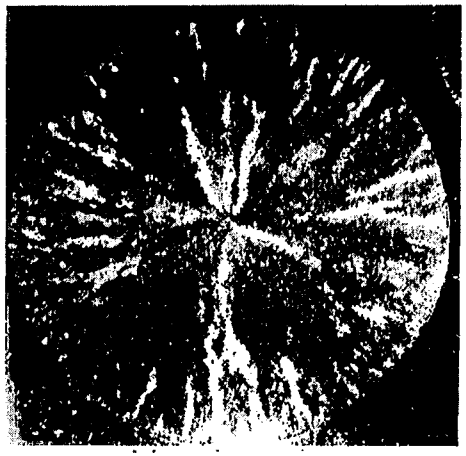
Figure 2E:
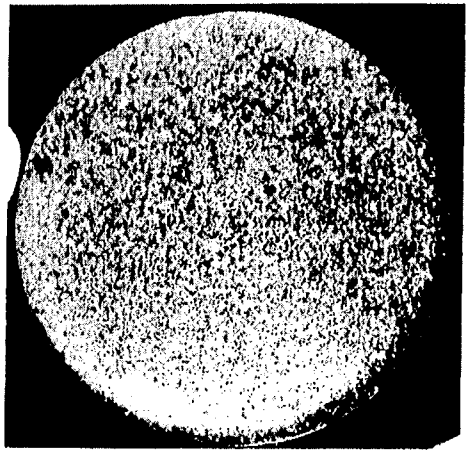
Figure 2F:
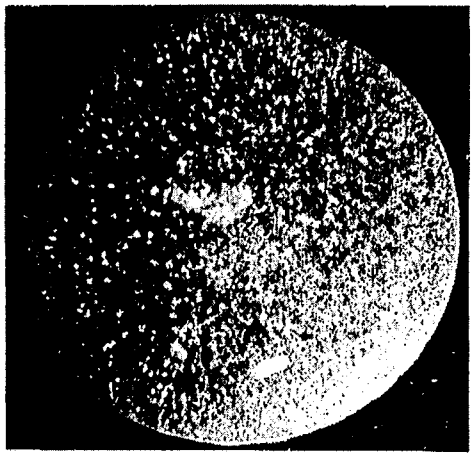

FIGS. 2A–2F illustrate the effect of boron concentration (expressed in atomic %) of the base alloy composition and of volume % boride dispersoids in the castings on the as-cast grain structure. It is evident that little or no grain refinement was observed in FIGS. 2A through FIG. 2D for the Alloy A, B, C and D castings. On the other hand, dramatic grain refinement was present in the Alloy E and F castings as shown in FIG. 2E and FIG. 2F. The transition from no observed grain refinement to dramatic grain refinement occurred between Alloy D (0.3 atomic % B) and Alloy E (1.0 atomic % B). The grain size of Alloy E casting and Alloy F casting were about 50 to about 150 microns, respectively.

Figure 3B:
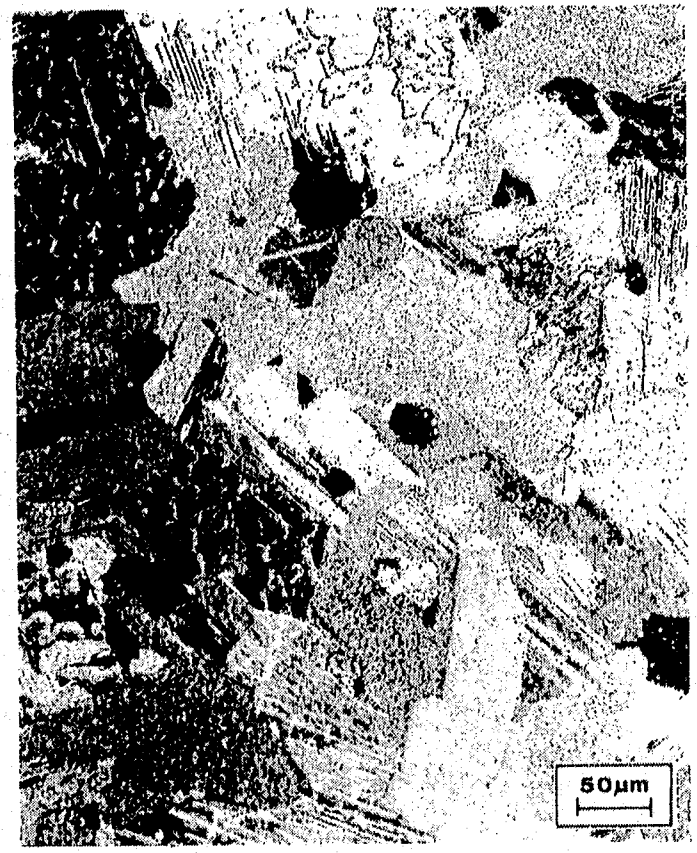
FIGS. 3A–3B are photomicrographs of the microstructures of investment castings illustrating the effect of heat treatment under different conditions on grain morphology.
Figure 3A:
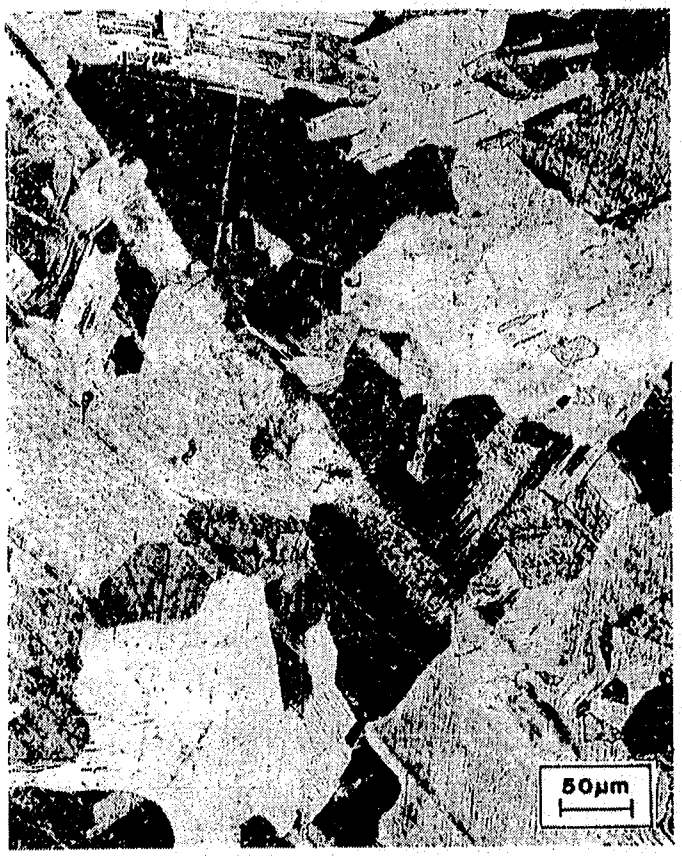
Figure 4C:
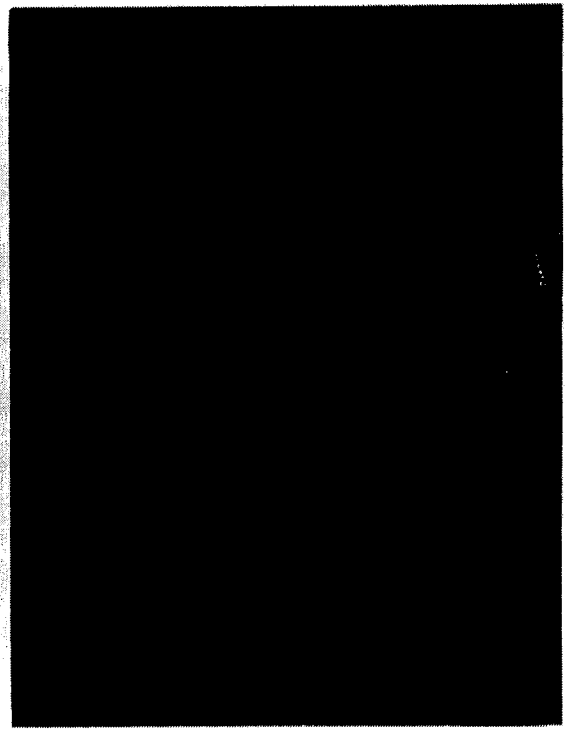
FIGS. 4A–4C are photomicrographs illustrating the boride dispersoids present in a particular Alloy D investment casting.
Figure 4B:
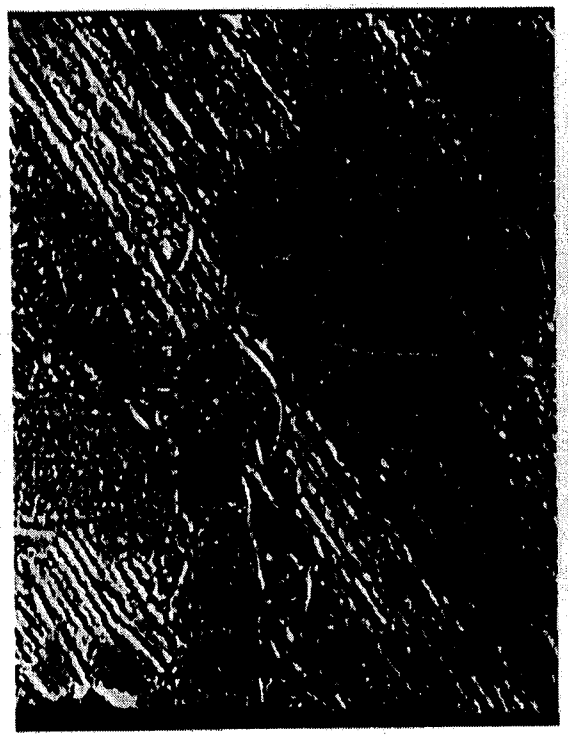
Figure 4A:
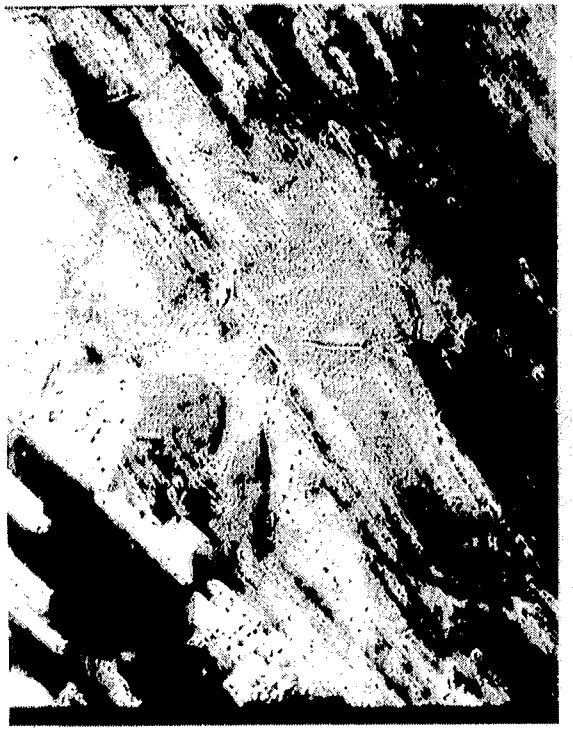
Figure 5C:
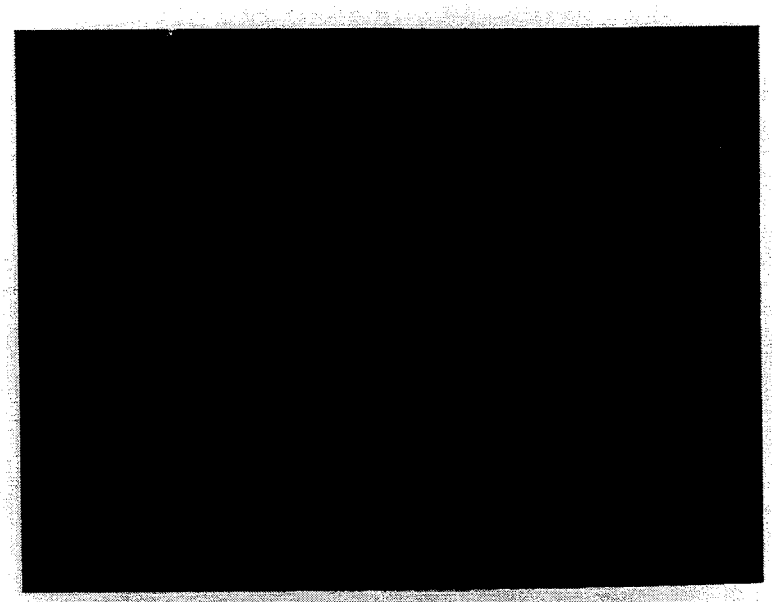
FIGS. 5A–5C are photomicrographs illustrating the boride dispersoids present in a particular Alloy E investment casting.
Figure 5B:
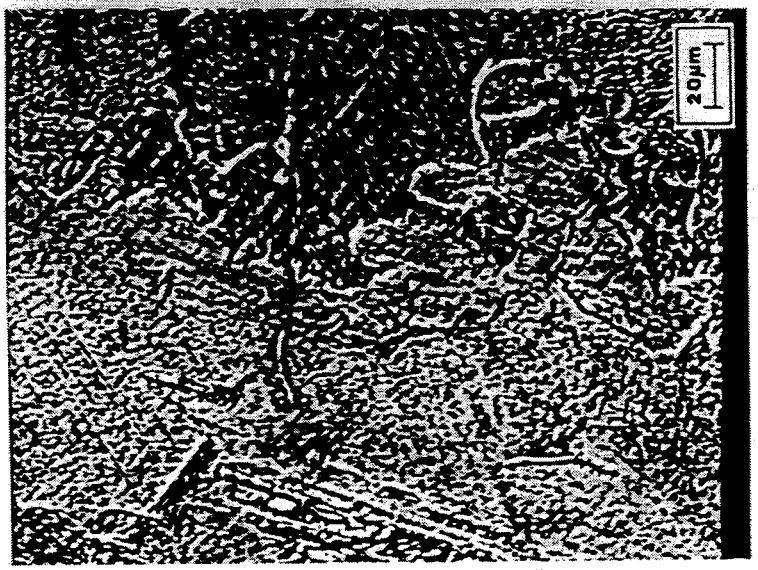
Figure 5A:
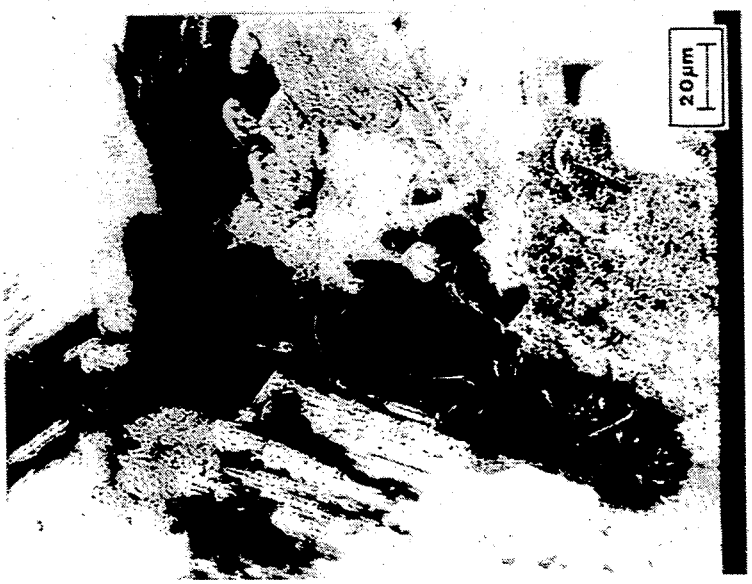
Figure 6C:
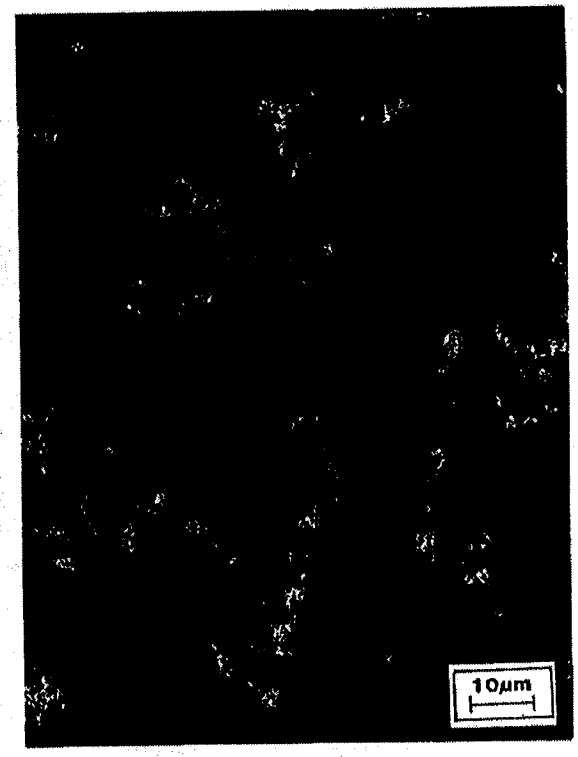
FIGS. 6A–6C are photomicrographs illustrating the boride dispersoids present in a particular Alloy F investment casting.
Figure 6B:
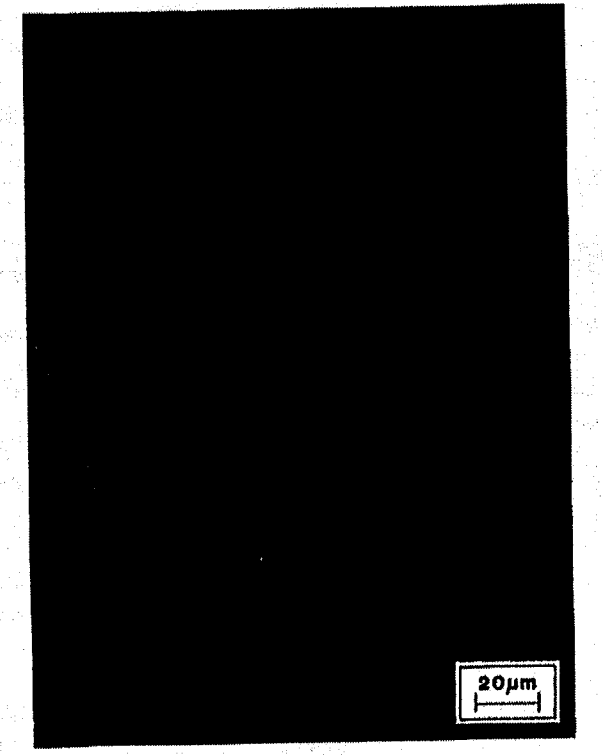
Figure 6A:
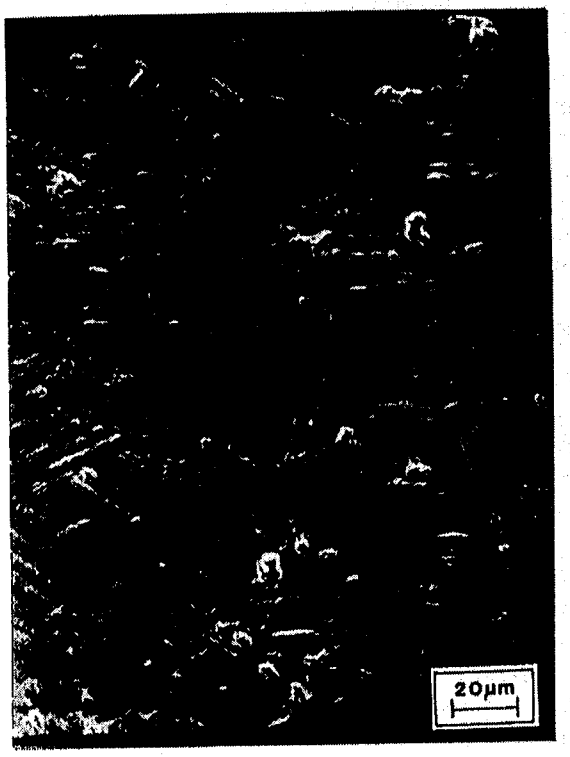

Alloy E castings were hot isostatically pressed at 2300° F. and 25 ksi for 4 hours and then subjected to different heat treatments to determine response of the as-cast lamellar grain structure to different temperatures. FIGS. 3A and 3B illustrate the change in grain structure from lamellar to partially equiaxed after heat treatments at 2100° F. and 1850° F. with the same time-at-temperature and gradual furnace cool (GFC). The change from lamellar to partially equiaxed grain structure is evident in both FIGS. 3A,3B.

FIGS. 4A–4C, 5A–5C, and 6A–6C illustrate the effects of boron concentration on the appearance of boride dispersoids in Alloys D, E and F, respectively, as consolidated/heat treated. Three different known electron microprobe techniques were used to view the dispersoids; namely, the secondary technique, the back scatter technique and the boron dot map. Based upon these Figures, the solubility of boron in the Ti-Al-Nb-Mn compositions set forth above appears to be less than 0.05 atomic % B.

Table 1 sets forth strength and ductility properties of the Alloy A, B, D, and E castings after HIP'ing at 2300° F. and 25 ksi for 4 hours followed by heat treatment at 1850° F. for 50 hours in an inert atmosphere. Included for comparison purposes in Table 1 is a base alloy (Ti-48%Al-2%Nb-2%Mn-0%B) HIP'ed using the same parameters and heat treated to a similar microstructure. Tensile tests were conducted at room (70° F.) temperature in accordance with ASTM E8M test procedure and at 1500° F. in accordance with ASTM E21 test procedure.

TABLE 1

| | TEST TEMP. (F.) | UTS (KSI) | YS (KSI) | ELONG. (%) |
|---|---|---|---|---|
| Base Alloy | 70 | 58.0 | 40.0 | 1.7 |
| | 1500 | 50.0 | 37.0 | 30.0 |
| Alloy A | 70 | 62.2 | 52.8 | 1.0 |
| | 1500 | 54.4 | 42.6 | 44.7 |
| Alloy B | 70 | 52.2 | 46.1 | 0.6 |
| | 1500 | 62.4 | 45.2 | 6.8 |
| Alloy D | 70 | 54.3 | 50.0 | 0.5 |
| | 1500 | 61.3 | 39.7 | 17.1 |
| Alloy E | 70 | 69.4 | 59.2 | 0.7 |
| | 1500 | 66.1 | 45.2 | 20.7 |

This combination strength and ductility properties represent significant improvements over those obtainable heretofore in the casting of gamma titanium aluminide (TiAl).

EXAMPLE 2

This example illustrates practice of another embodiment of the invention wherein preformed boride dispersoids ($TiB_2$) are provided in the TiAl base alloy melt by adding a master boride material thereto. The master boride material comprised a porous sponge having 70 weight % of borides ($TiB_2$) in an Al matrix metal. Various amounts of the sponge material were added to the TiAl base alloy melt so as to determine the dependence of grain refinement on the amount (volume %) of boride dispersoids present in the melt. The following melt compositions were prepared by the VAR melting process referred to hereabove:

Alloy OXD - - - Ti-45.4% Al-1.9% Nb-1.4% Mn-0 vol. % $TiB_2$ (0 at. % B)

Alloy 1XD - - - Ti-45.4% Al-1.9% Nb-1.4% Mn- 0.1 vol. % $TiB_2$ (0.17 at. % B or 0.1 volume % borides)

Alloy 2XD - - - Ti-46.1% Al-1.8% Nb-1.6% Mn-0.4 vol. % $TiB_2$ (0.50 at. % B or 0.4 volume % borides)

Alloy 3XD - - - Ti-47.7% Al-2.0% Nb-2.0% Mn-1.0 vol. % $TiB_2$ (1.40 at. % B or 1.0 volume % borides)

Alloy 4XD - - - Ti-44.2% Al-2.0% Nb-1.4% Mn-2.0 vol. % $TiB_2$ (2.59 at. % B)

Alloy 5XD - - - Ti-45.4% Al-1.9% Nb-1.6% Mn-4.6 vol. % $TiB_2$ (5.97 at.% B or 4.6 volume % borides)

Interstitial concentrations in these alloys are set forth below:

| | INTERSTITIALS (ppm wt %) | | |
|---|---|---|---|
| | O | N | H |
| Alloy 0XD— | 716 | 42 | 6 |
| Alloy 1XD— | 632 | 58 | 9 |
| Alloy 2XD— | 684 | 68 | 14 |
| Alloy 3XD— | 538 | 47 | 10 |
| Alloy 4XD— | 795 | 90 | 10 |
| Alloy 5XD— | 654 | 48 | 13 |

Each of these TiAl base alloy compositions was fabricated into a cylindrical electrode by the procedure described hereinabove for Example 1. After double melting as described above, each electrode was subjected to a surface treatment operation using a SiC grinding tool, grit blasting (or alternatively chemical milling operation using 10% HF aqueous solution as an etchant) to remove surface oxidation therefrom. About a 0.020 inch depth was removed from the electrode. Each electrode was then VAR melted by direct electric arc heating into a copper crucible to form a TiAl base alloy melt to which the preformed master sponge was added.

Each TiAl alloy melt was maintained at a superheat temperature of about 25° F. above the alloy melting point by electric arc melting prior to casting. Each melt was poured from the crucible into a preheated (600° F.) ceramic investment mold comprising a $Zr_2O_3$ mold facecoat for contacting the melt and nine backup coats of $Al_2O_3$. Each mold included five mold cavities in the shape of cylinders having the following dimensions: 0.625 inch diameter×8 inches long. Each melt was melted and cast into the mold under a 7micron vacuum. Each melt-filled mold was placed in a bed of $Al_2O_3$ (to a depth of about 8 inches) and allowed to cool to ambient temperature over a period of about 2 hours. Each mold and the cylindrical-shaped castings were then separated.

Figure 7C:
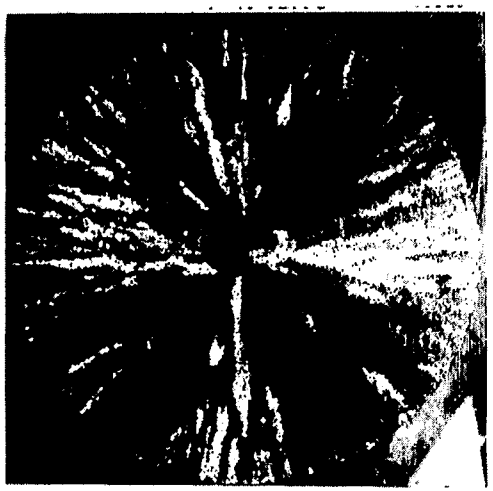
FIGS. 7A–7F are photomicrographs of investment castings illustrating the effect of increasing borides (added by master boride material) in the melt on grain refinement.
Figure 7B:
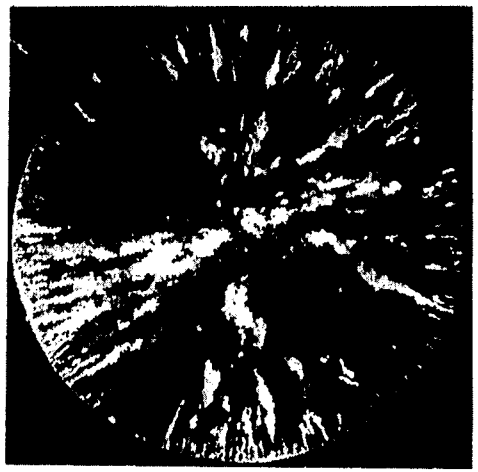
Figure 7A:
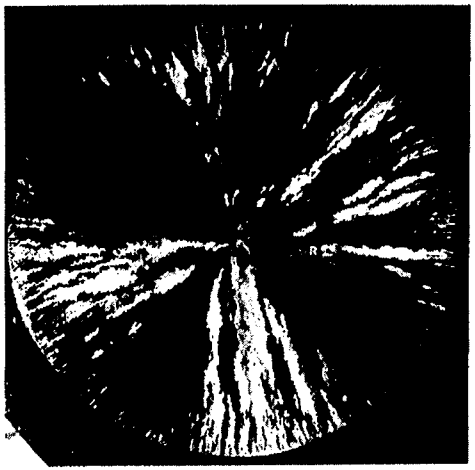
Figure 7F:
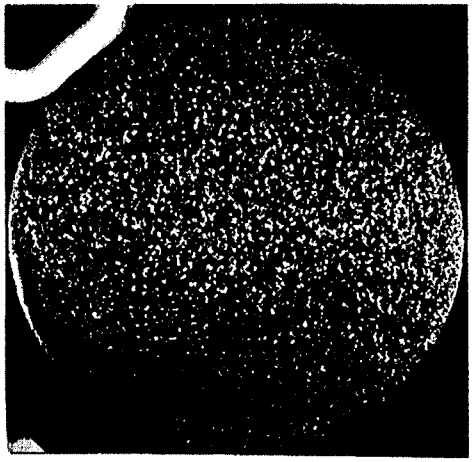
Figure 7E:
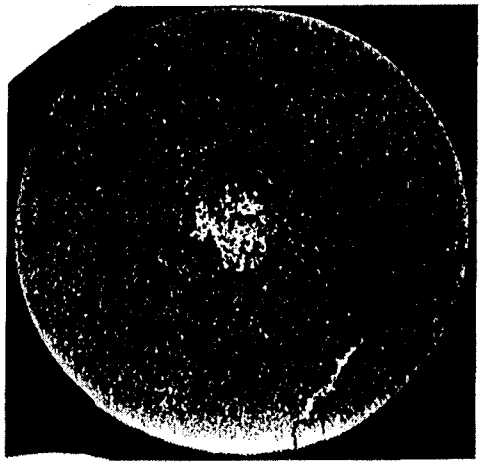
Figure 7D:
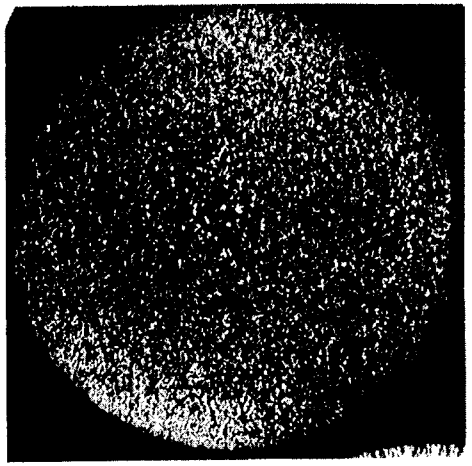
Figure 8C:
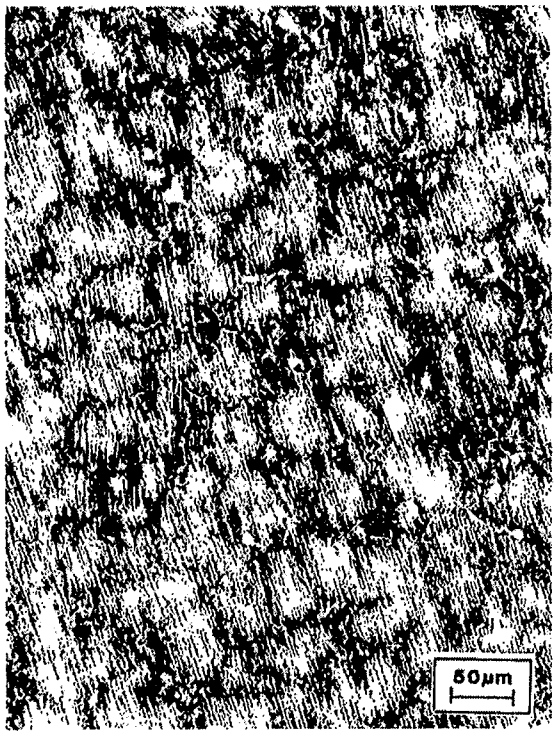
FIG. 8A–8F are photomicrographs of the as-cast microstructures of the investment castings of FIGS. 6A–6F.
Figure 8B:
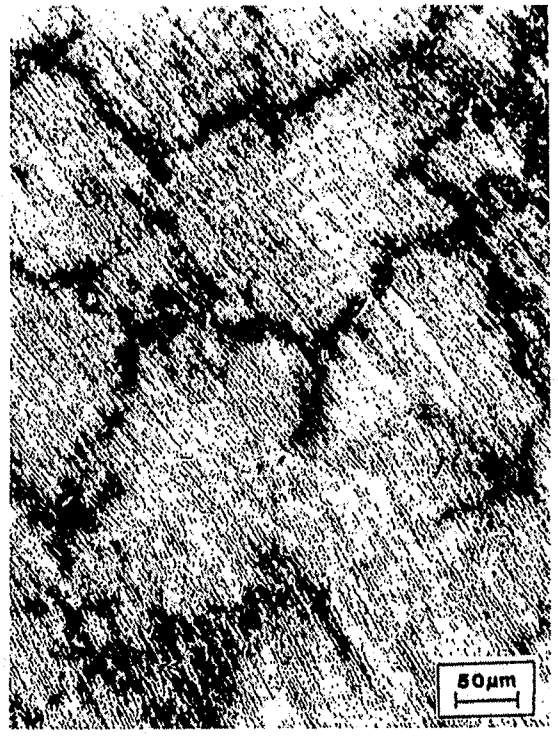
Figure 8A:
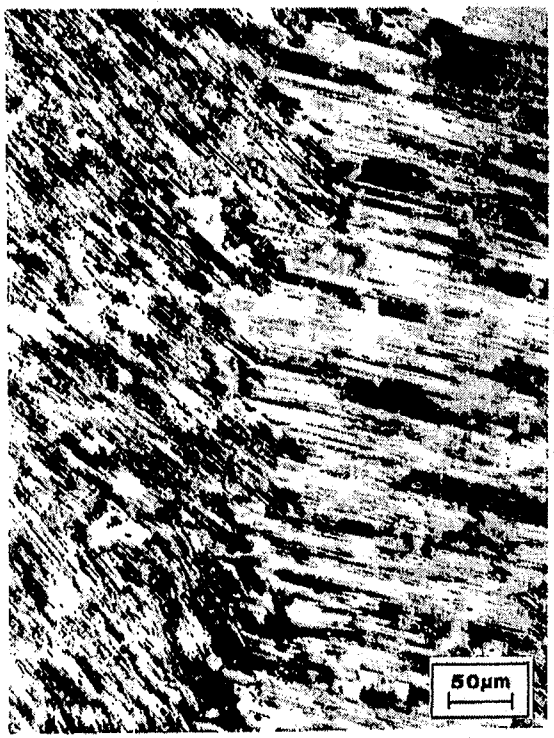
Figure 8F:
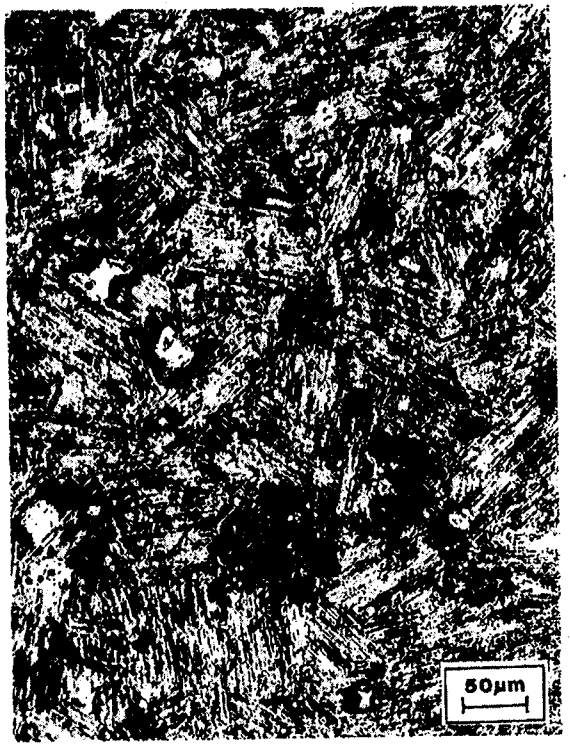
Figure 8E:
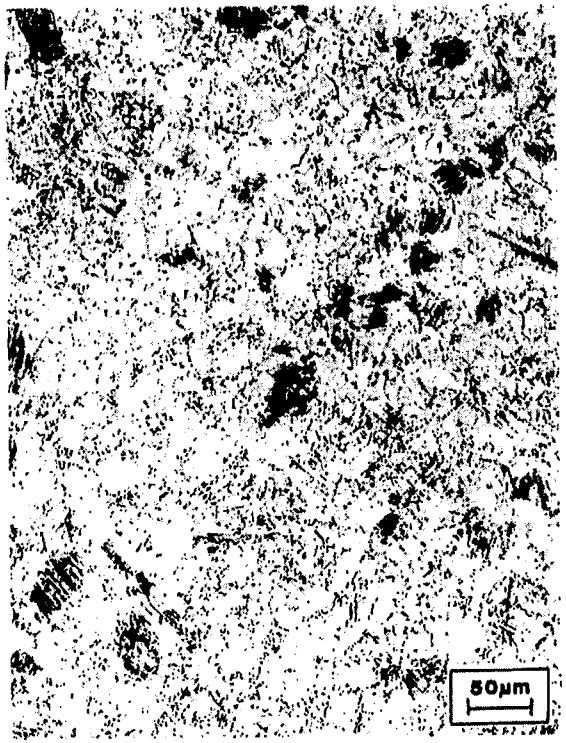
Figure 8D:
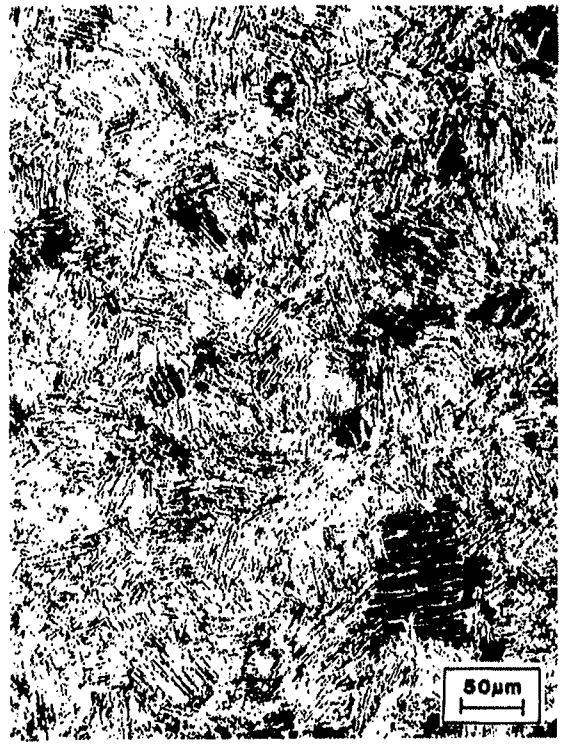
Figure 9C:
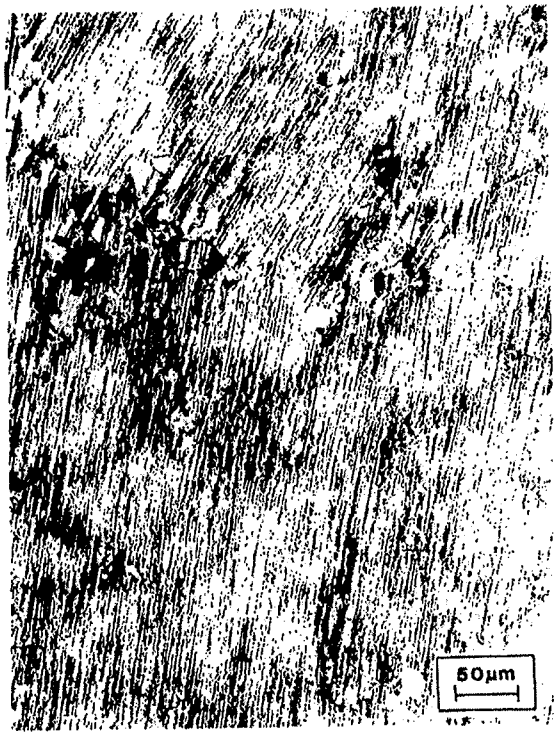
FIG. 9A–9F are photomicrographs of the hot isostatically pressed microstructures of the investment castings of FIGS. 7A–7F.
Figure 9B:
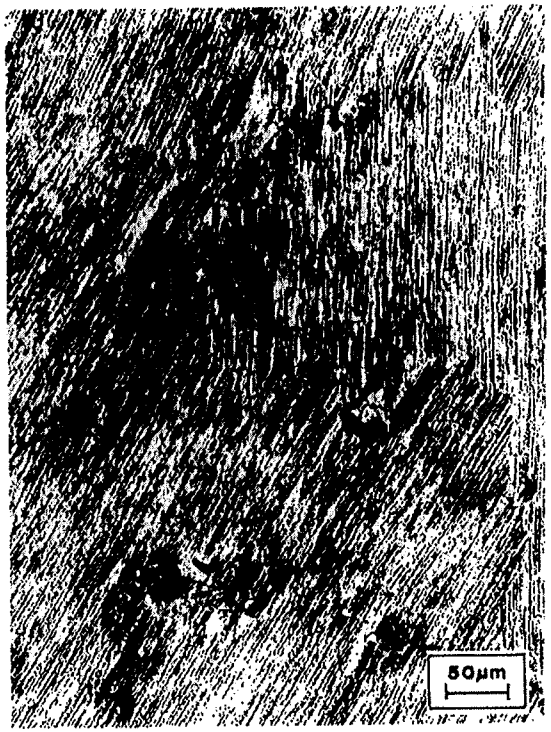
Figure 9A:
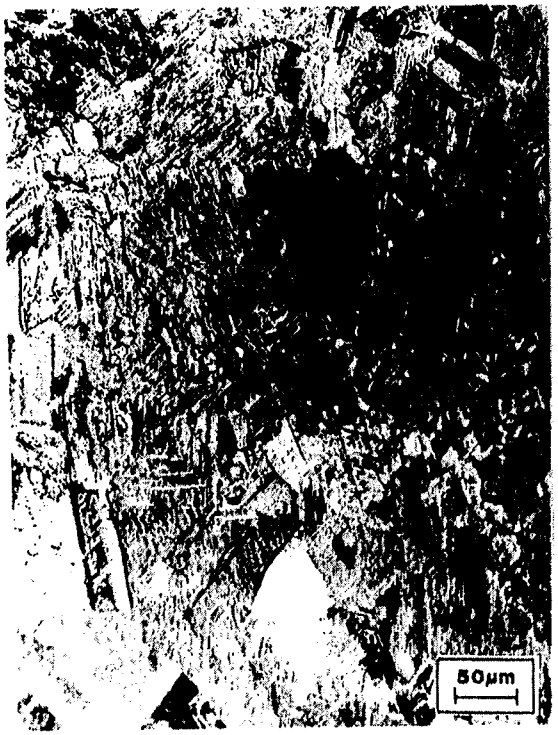
Figure 9F:
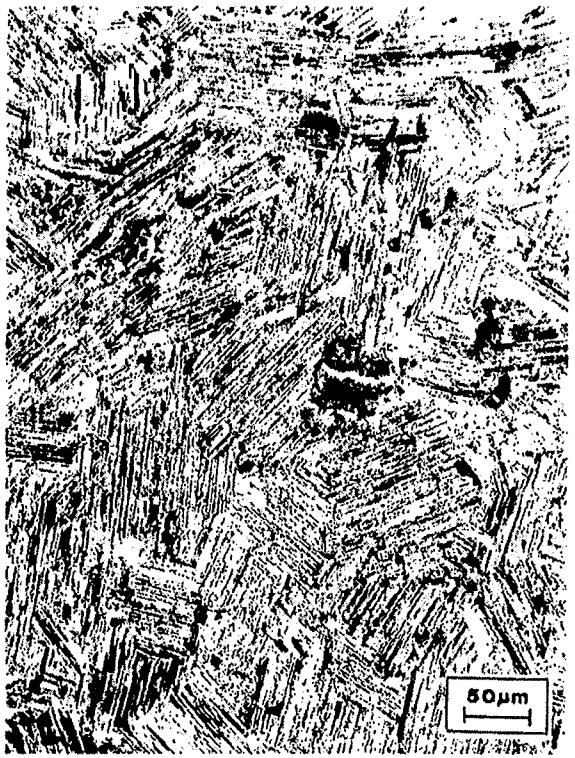
Figure 9E:
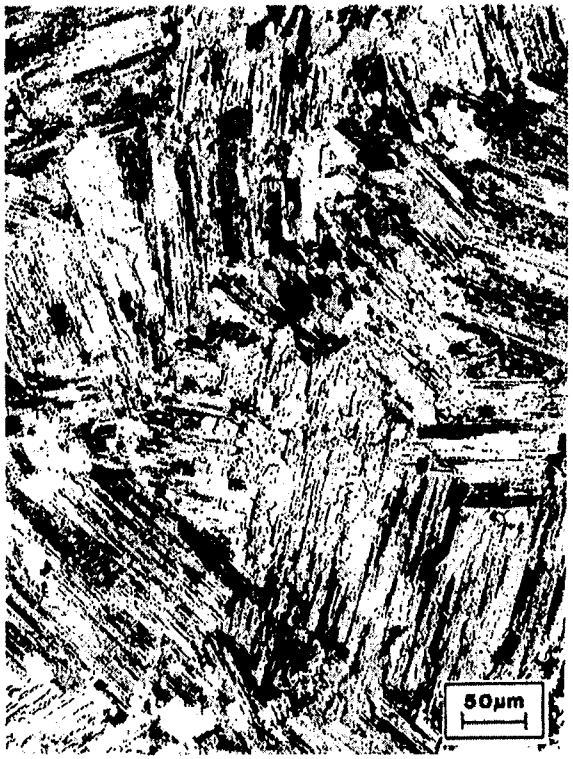
Figure 9D:
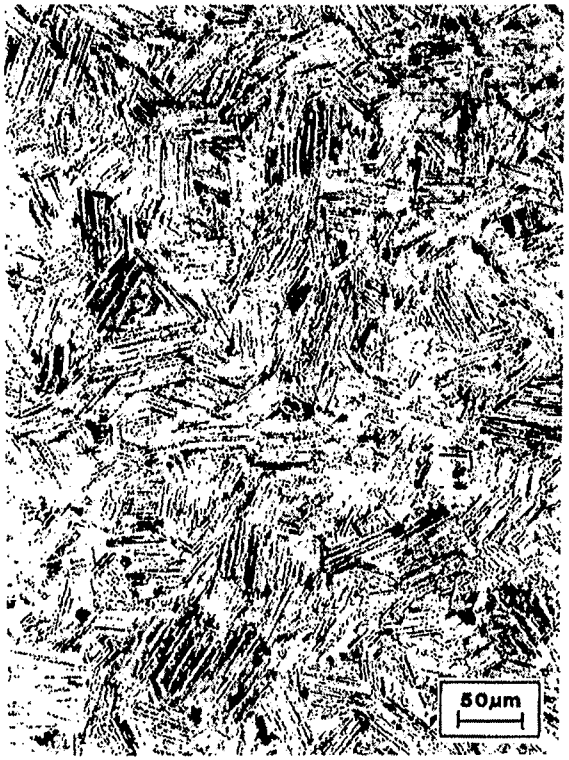

FIGS. 7A–7F illustrate the effect of boride loading (volume %) on the as-cast grain structure of Alloys 1XD through 5XD, respectively. It is evident from FIGS. 7A through 7C, that little or no grain refinement was observed for the Alloy 0XD, 1XD and 2XD castings. On the other hand, dramatic grain refinement was present in the Alloy 3XD, 4XD and 5XD castings as shown in FIGS. 7D through 7F. The transition from no observed grain refinement to dramatic grain refinement occurred between Alloy 2XD (0.4 vol. % $TiB_2$) and Alloy 3XD (1.0 vol. % $TiB_2$). The grain size of Alloy 3XD, 4XD and 5XD castings was about 50 to about 150 microns.

FIGS. 8A–8F illustrate the as-cast microstructures of the castings 0XD–5XD, respectively.

FIGS. 9A–9F illustrate the as-HIP'ped microstructures of the castings 0XD-5XD, respectively.

Figure 10B:
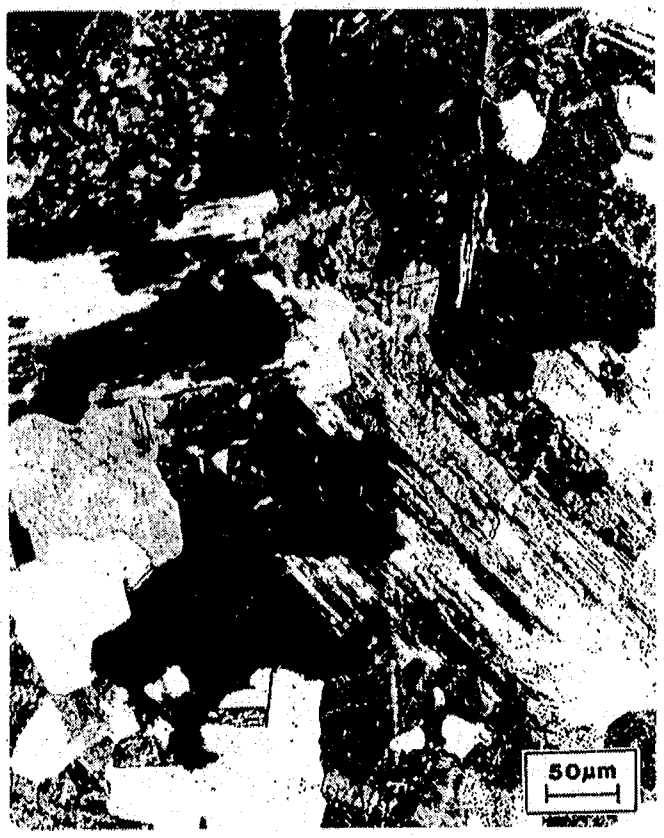
FIGS. 10A–10B are photomicrographs of the microstructures of investment castings illustrating the effect of heat treatment under different conditions on grain morphology.
Figure 10A:
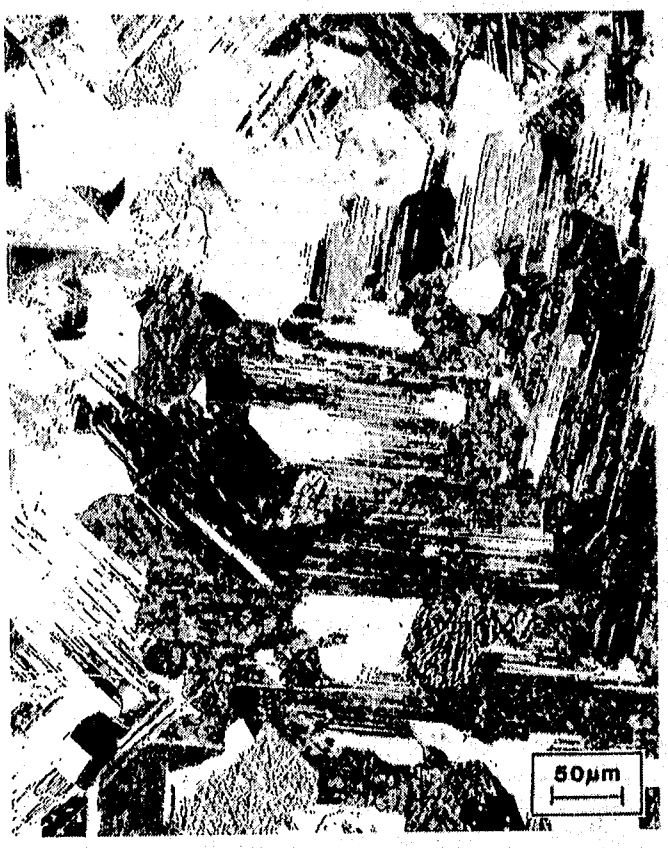
Figure 11C:
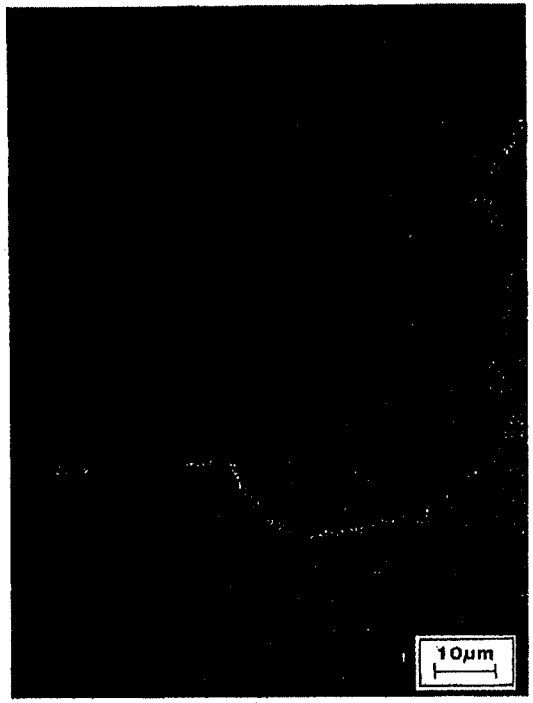
FIGS. 11A–11C are photomicrographs illustrating the boride dispersoids present in a particular Alloy 1XD investment casting (as-cast).
Figure 11B:
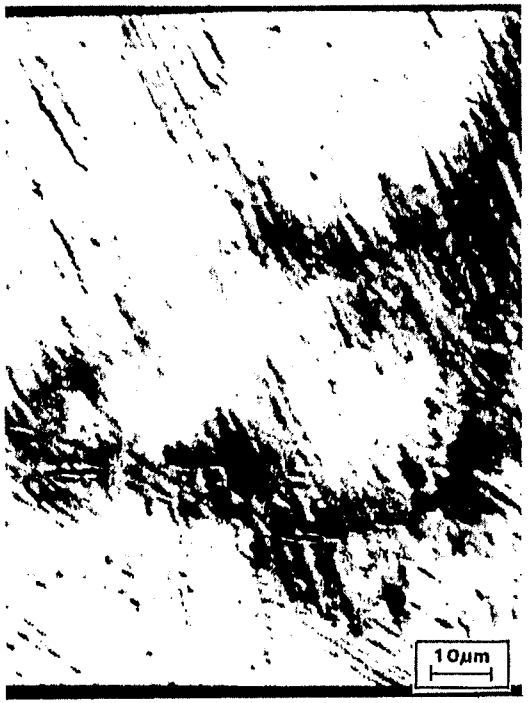
Figure 11A:
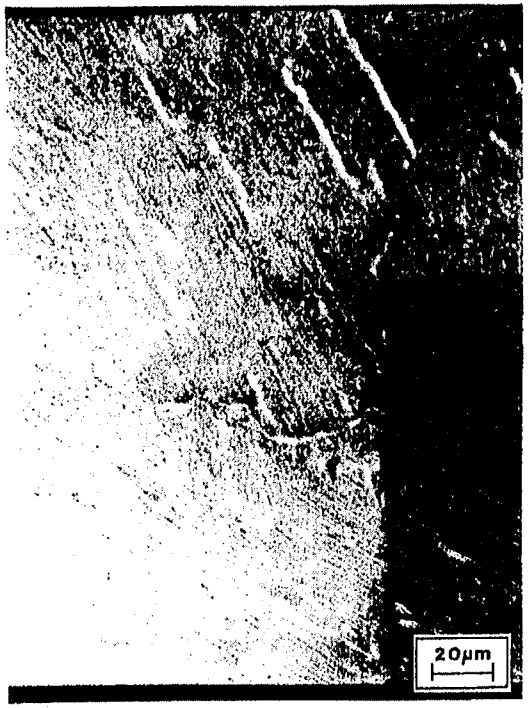
Figure 12C:
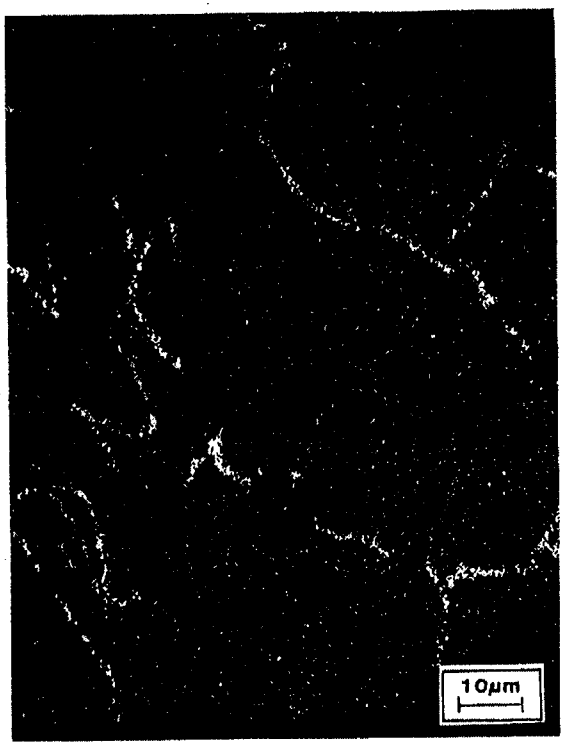
FIGS. 12A–12C are photomicrographs illustrating the boride dispersoids present in a particular Alloy 2XD investment casting (as-cast).
Figure 12B:
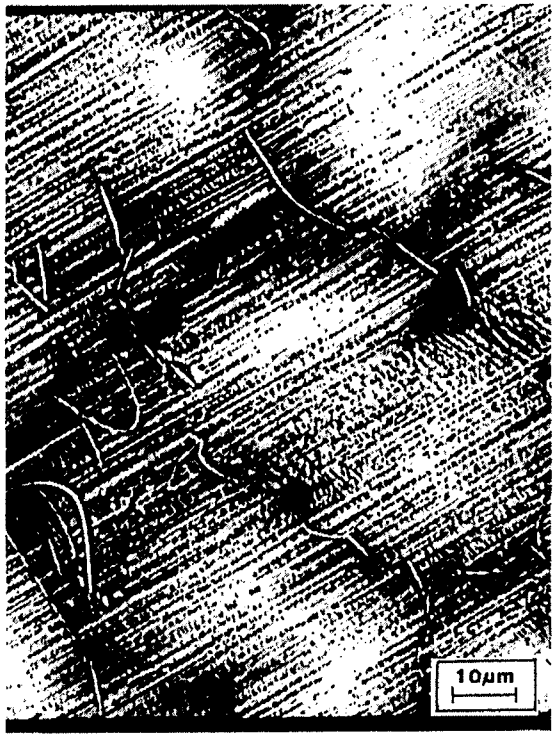
Figure 12A:
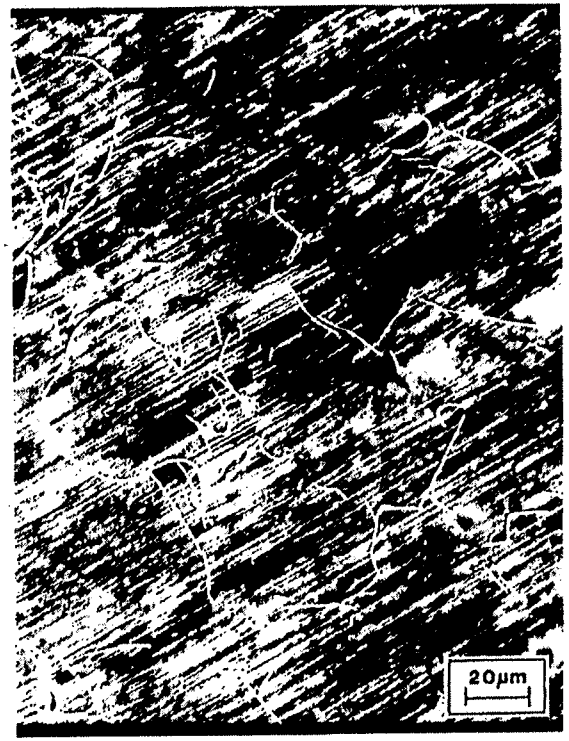
Figure 13C:
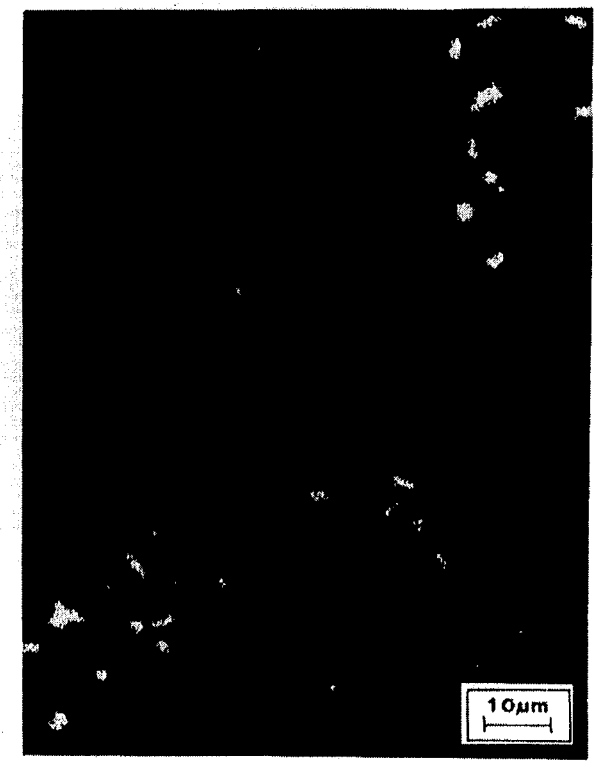
FIGS. 13A–13C are photomicrographs illustrating the boride dispersoids present in a particular Alloy 3XD investment casting (as-cast).
Figure 13B:
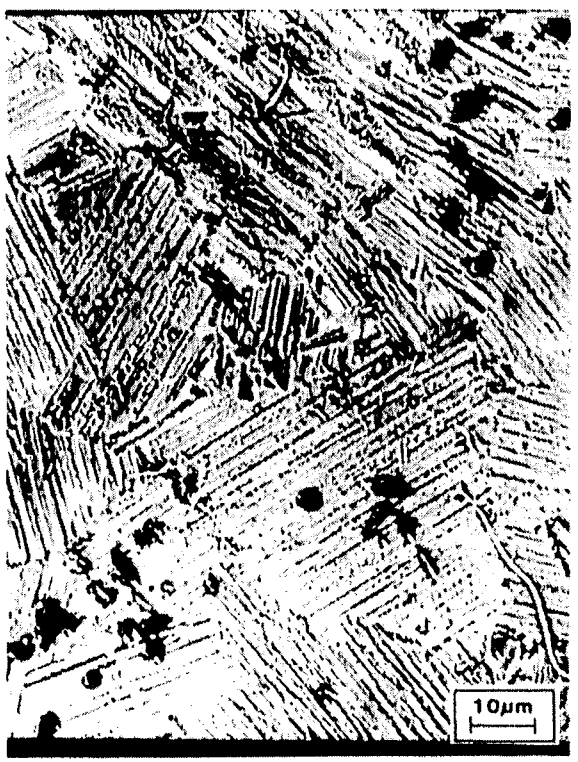
Figure 13A:
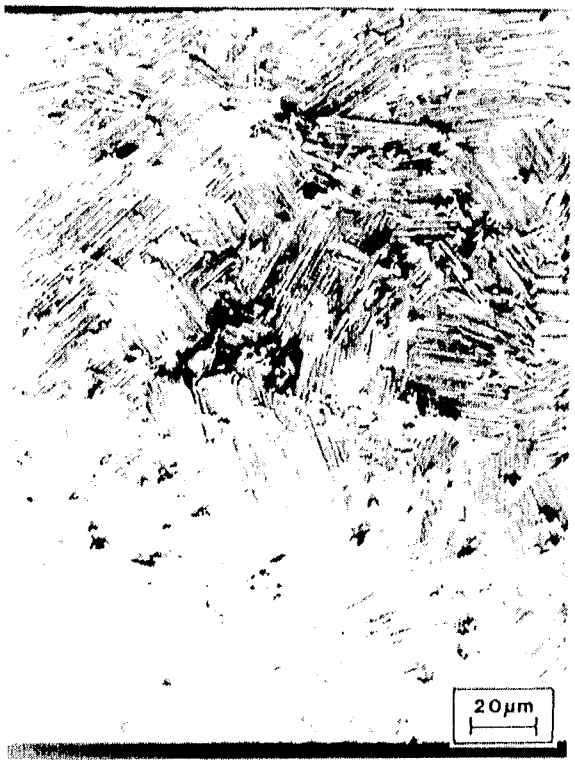
Figure 14C:
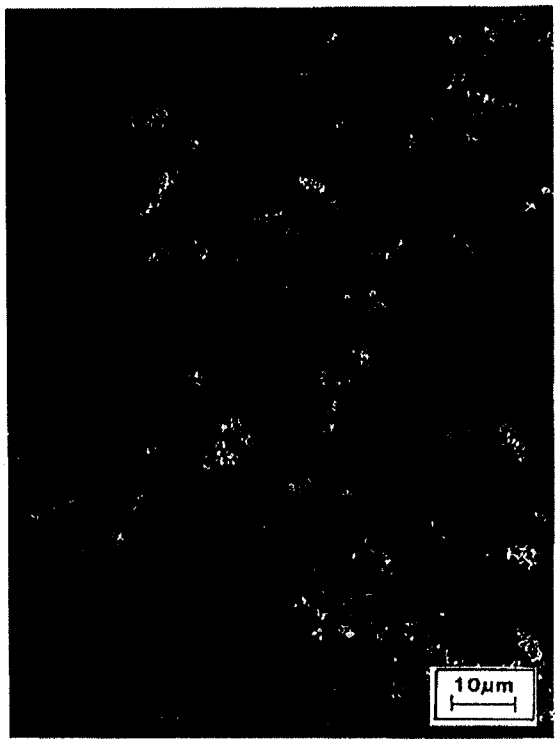
FIGS. 14A–14C are photomicrographs illustrating the boride dispersoids present in a particular Alloy 5Xd investment casting (as-cast).
Figure 14B:
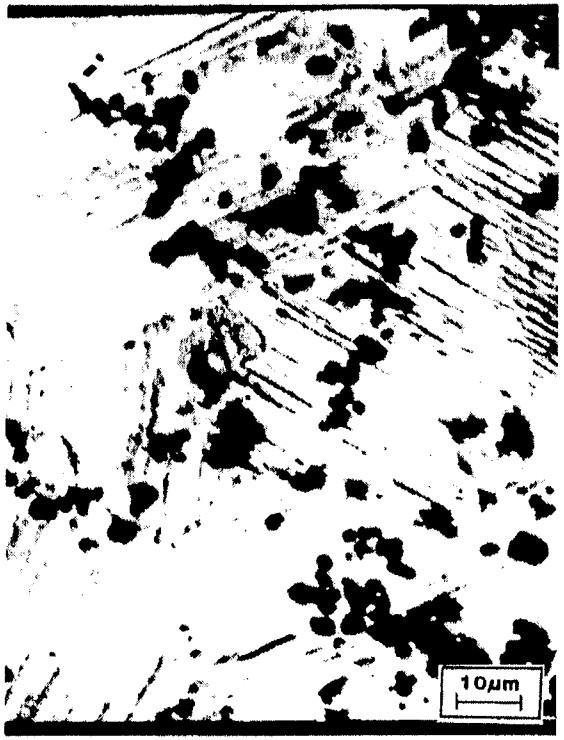
Figure 14A:
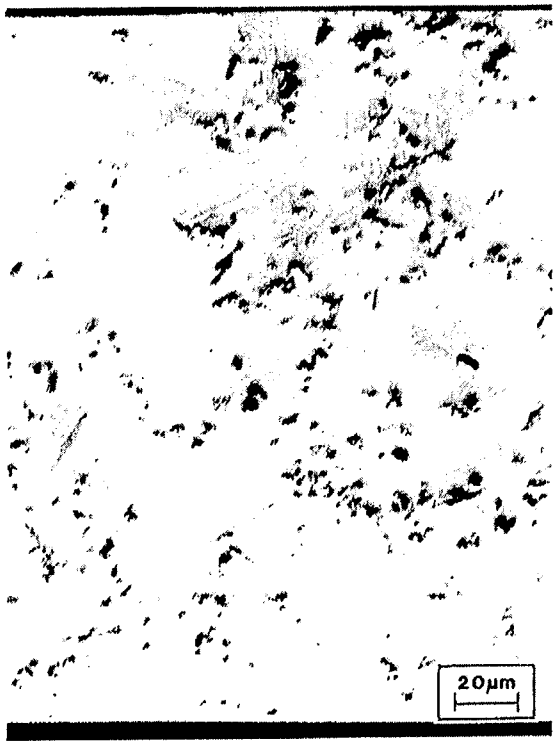
Figure 15C:
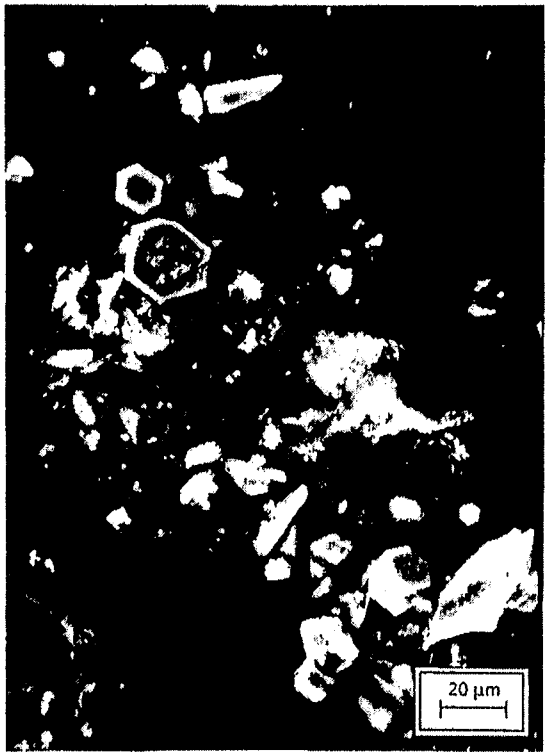
FIGS. 15A–15C are photomicrographs illustrating boride particles extracted from the Alloy 2XD investment casting (as-cast).
Figure 15B:
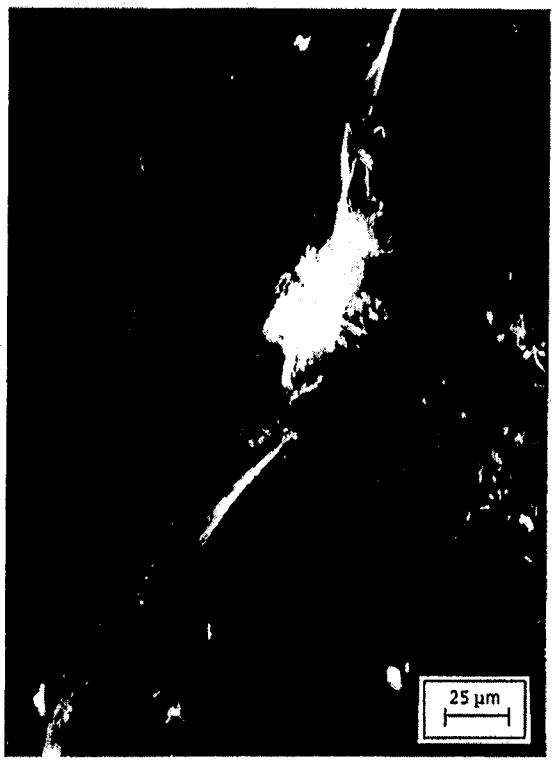
Figure 15A:
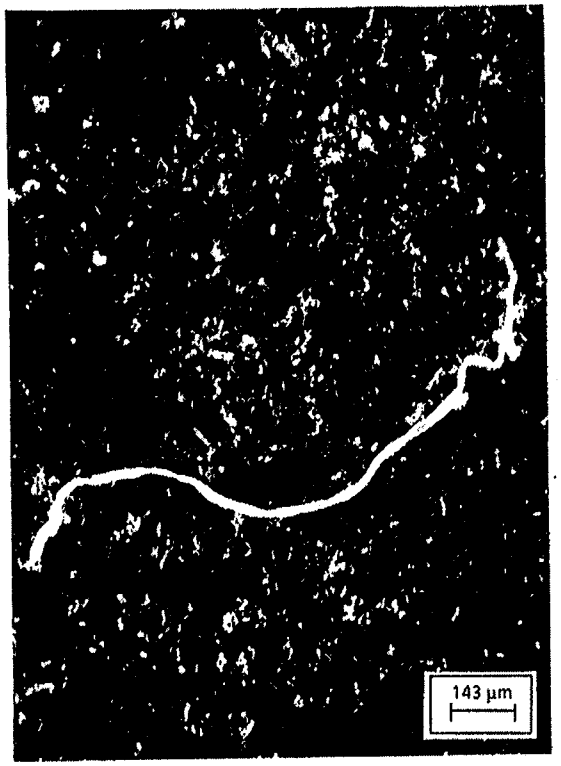
Figure 16C:
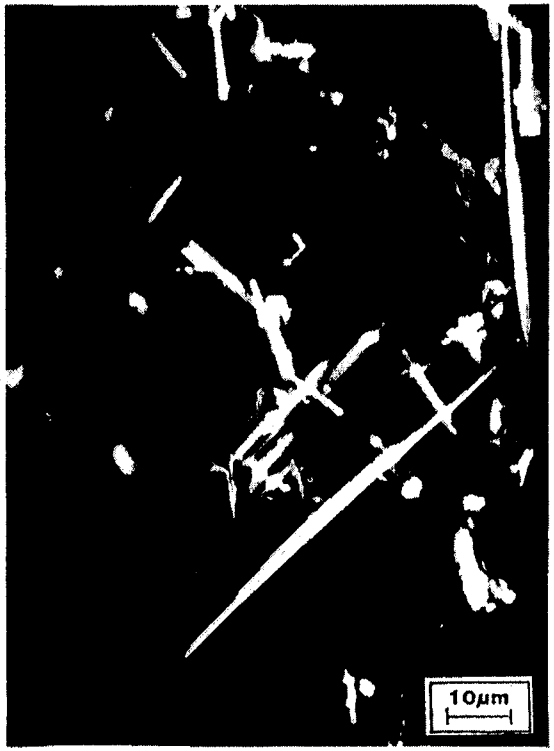
FIGS. 16A–16C are photomicrographs illustrating boride particles extracted from the Alloy 3XD investment casting (as-cast).
Figure 16B:
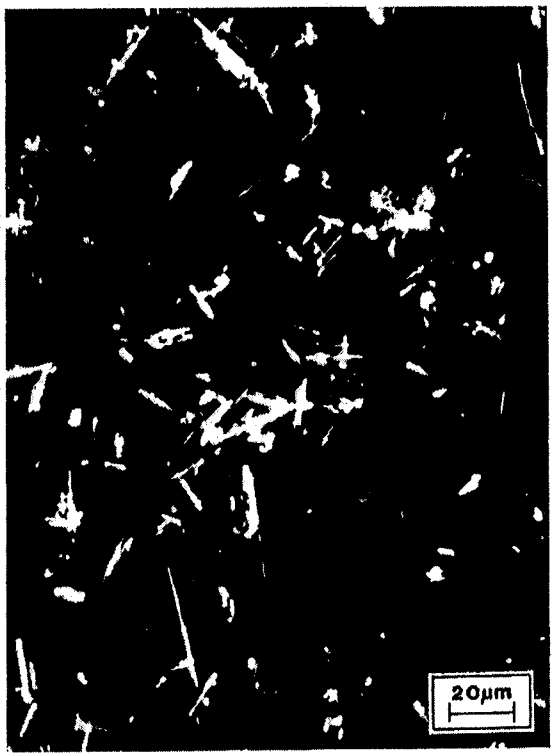
Figure 16A:
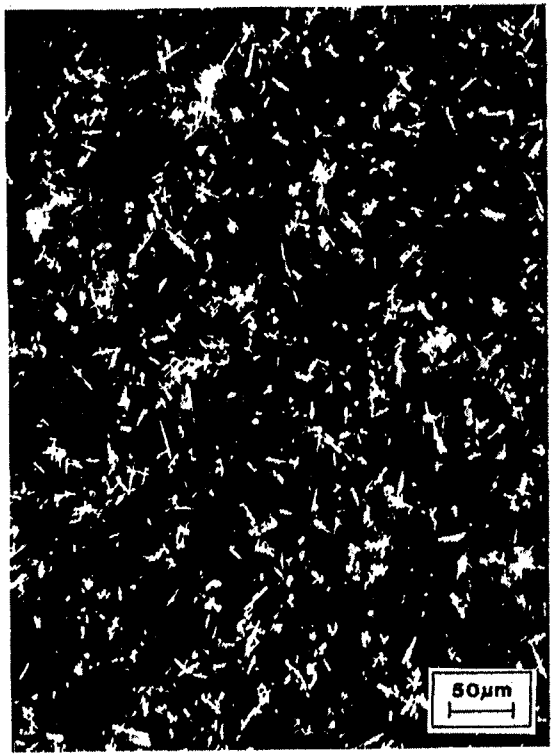
Figure 17A:
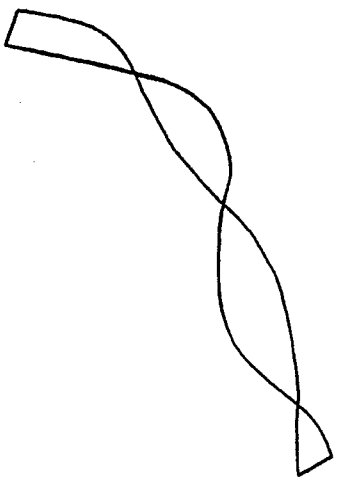
FIG. 17A–17D are schematic illustrations of boride particles of various morphology that occur in the investment castings.
Figure 17B:
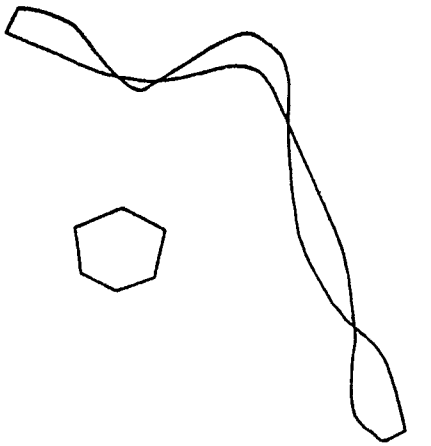
Figure 17C:
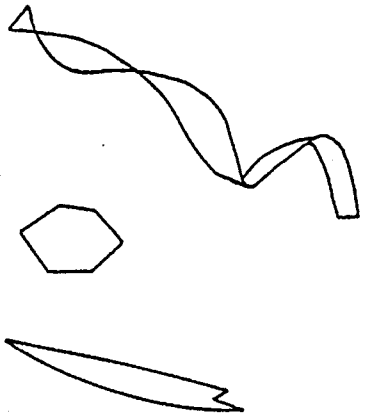
Figure 17D:
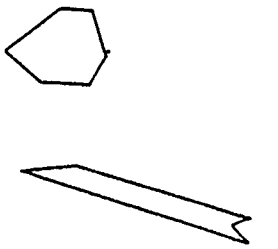

Alloy 3XD castings were hot isostatically pressed at 2300° F. and 25 ksi for 4 hours and then subjected to different heat treatments to determine response of the as-cast lamellar grain structure to different temperatures. FIGS. 10A and 10B illustrate the change in grain structure from lamellar to partially equiaxed after heat treatments at 2100° F. and 1850° F. with the same time-at-temperature and gradual furnace cool. The change from lamellar to equiaxed grain structure is evident in both FIGS. 10A,10B.

FIGS. 11A–11C, 12A–12C, 13A–13C and 14A–14C illustrate the effects of boron concentration on the appearance of boride dispersoids in Alloys 1XD, 2XD, 3XD, and 5XD, respectively, as-cast. Three different known electron microprobe techniques were used to view the dispersoids; namely, the secondary technique, the back scatter technique and the boron dot map.

FIGS. 15A–15C and 16A–16C illustrate various $TiB_2$ particle shapes extracted from Alloy 2XD and 3XD, respectively.

Table 2 sets forth strength and ductility properties of the Alloy 2XD and 3XD castings after HIP'ing at 2300° F. and 25 ksi for 4 hours followed by heat treatment at 1850° F. for 50 hours in an inert (Ar) atmosphere. Tensile tests were conducted at room (70° F.) temperature and at 1500° F. in accordance with ASTM E8M and E21 test procedures, respectively.

TABLE 2

| | TEST TEMP. (F.) | UTS (KSI) | YS (KSI) | ELONG. (%) | AVERAGE GRAIN SIZE |
|---|---|---|---|---|---|
| Alloy 2XD | 70 | 62.2 | 51.0 | 1.0 | 1000 um |
| | 1500 | 65.8 | 45.2 | 10.0 | |

TABLE 2-continued

| | TEST TEMP. (F.) | UTS (KSI) | YS (KSI) | ELONG. (%) | AVERAGE GRAIN SIZE |
|---|---|---|---|---|---|
| Alloy 3XD | 70 | 84.4 | 78.2 | 0.7 | 75 um |
| | 1500 | 60.6 | 48.4 | 8.9 | |

This combination of strength and ductility properties represent significant improvements over those heretofore obtainable in the prior art cast gamma (TiAl) titanium aluminide alloys.

EXAMPLE 3

This example illustrates practice of still another embodiment of the invention wherein a charge of Ti sponge, Al pellets, Al/Mn master alloy chunks, Al/Nb master alloy chunks and elemental boron powder are melted using the induction skull melting procedure. In particular, the charge was melted in a segmented, water-cooled copper crucible such that a solidified metal skull formed on the crucible surfaces shortly after melting of the melting of the charge. The charge was melted by energization of an induction coil positioned about the crucible (see U.S. Pat. No. 4,923,508) and was maintained at a superheat temperature of about 50° F. above the alloy melting point by induction heating. The melt was stirred as a result of the induction heating.

The melt was poured from the crucible into a preheated (600° F.) ceramic investment mold comprising a $Zr_2O_3$ mold facecoat for contacting the melt and nine back-up coats of $Al_2O_3$. Each mold included 5 mold cavities in the shape of cylinders having the following dimensions: 0.652 inch diameter×8 inches long. Each melt was melted under 0.5 atmosphere Ar and cast into the mold under 200 microns vacuum. Each melt-filled mold was placed in a bed of $Al_2O_3$ (to a depth of about 8 inches) and allowed to cool to ambient temperature over a period of about 2 hours. Each mold and the cylindrical-shaped castings were then separated.

The following melt compositions (in atomic %) were ISR melted and investment cast as described above:

Alloy 1 - - - Ti-45.6% Al-1.9% Nb-2.3% Mn-1.10% B

Alloy 2 - - - Ti-45.1% Al 1.9% Nb-2.2% Mn-2.4% B

For comparison purposes, two alloys (XD0 and XD7) were prepared in accordance with Example 2 to include 0 volume % and 7 volume % titanium borides.

Table 3 sets forth room temperature strength and ductility properties of Alloys 1–2 after HIP'ing at 2300° F. and 25 ksi for 4 hours followed by heat treatment at 1650° F. for 24 hours in inert (Ar) atmosphere. Alloys XD0 and XD7 (Ti-48% Al-2% Nb-2% Mn with 0 volume % and 7 volume % borides, respectively) were HIP'ed using the same parameters and heat treated to a similar microstructure. The room temperature tensile tests were conducted pursuant to ASTM ESM test procedure.

TABLE 3

| | ROOM TEMPERATURE TENSILE RESULTS | | | |
|---|---|---|---|---|
| | BORIDE/ BORON AMOUNT | YIELD STRENGTH | ULTIMATE STRENGTH | PLASTIC ELONGATION |
| XD0 | 0 | 40.0 | 58.0 | 1.7 |
| XD7 | 7 Vol. % | 65.0 | 79.0 | 0.5 |
| Alloy 1 | 1.10 At % B | 74.0 | 89.0 | 1.3 |
| Alloy 2 | 2.40 At % B | 75.0 | 86.0 | 0.9 |

While the invention has been described in terms of specific embodiments thereof, it is not intended to be limited thereto but rather only to the extent set forth in the following claims.

I claim:

1. A titanium aluminide base article having an investment cast net or near-net shape for intended service application, said article having a titanium aluminide-containing matrix consisting essentially of about 40 to about 52 atomic % Ti, about 44 to about 52 atomic % Al and one or more of Cr, C, Ga, Mo, Mn, Nb, Ni, Si, Ta, V and W each in an amount of about 0.05 to about 8 atomic % said article having at least about 0.5 volume % grain refining boride dispersoids distributed throughout the matrix and being heat treated to have a yield strength of at least about 55 ksi and a ductility of at least about 0.5%.

2. A titanium aluminide base article having an investment cast net or near-net shape for intended service application, said article having a titanium aluminide-containing matrix consisting essentially of about 44 to about 50 atomic Ti, about 46 to about 49 atomic % Al, and one or more of Cr, C, Ga, Mo, Mn, Nb, Si, Ta, V, and W, said Cr, Ga, Mo, Mn, Nb, Ta, V and W being in an amount of about 1 to about 5 atomic %, and said C, Ni and Si being in an amount of about 0.05 to about 1 atomic %, said article having at least about 0.5 volume % grain refining boride dispersoids distributed throughout the matrix and being heat treated to have a yield strength of at least about 60 ksi and a ductility of at least about 1.0%.

3. The article of claims 1 or 2 wherein the matrix includes at least two of Cr, C, Ga, Mo, Mn, Nb, Ni, Si, Ta, V and W.

4. The article of claims 1 or 2 wherein the matrix has fine grain structure having a grain size of about 10 to about 250 microns.

5. The article of claims 1 or 2 wherein the boride dispersoids are present from about 0.5 to about 2 volume %.

6. A titanium aluminide base article having an investment cast net or near-net shape for intended service application, said article having a titanium aluminide-containing matrix consisting essentially of titanium in an amount of about 44 to about 50 atomic %, aluminum in an amount of about 46 to about 49 atomic %, niobium in an amount of about 1 to about 5 atomic %, and manganese in an amount of about 1 to about 5 atomic %, said article having at least about 0.5 volume % grain refining boride dispersoids distributed throughout the matrix and being heat treated to have a yield strength of at least about 55 ksi and a ductility of at least about 0.5 %.

* * * * *